US009104130B2

(12) United States Patent
Hasegawa et al.

(10) Patent No.: US 9,104,130 B2
(45) Date of Patent: Aug. 11, 2015

(54) IMAGE FORMING APPARATUS WITH CONTROL OF CHARGING VOLTAGE OF PHOTOSENSITIVE MEMBER

(71) Applicant: CANON KABUSHIKI KAISHA, Tokyo (JP)

(72) Inventors: Hideaki Hasegawa, Suntou-gun (JP); Takuya Kitamura, Yokohama (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/085,200

(22) Filed: Nov. 20, 2013

(65) Prior Publication Data

US 2014/0147139 A1 May 29, 2014

(30) Foreign Application Priority Data

Nov. 28, 2012 (JP) ..... 2012-259735

(51) Int. Cl.
*G03G 15/02* (2006.01)
*G03G 15/043* (2006.01)

(52) U.S. Cl.
CPC ..... *G03G 15/0266* (2013.01)

(58) Field of Classification Search
CPC ..... G03G 15/0266
USPC ..... 399/50, 51
See application file for complete search history.

(56) References Cited

U.S. PATENT DOCUMENTS 6,205,298 B1 * 3/2001 Yamamoto ..... 399/25
2006/0140650 A1 * 6/2006 Yokote ..... 399/27
2008/0175634 A1 * 7/2008 Shin et al. ..... 399/346
2010/0040389 A1 * 2/2010 Akatsu ..... 399/48
2012/0027437 A1 * 2/2012 Maruyama et al. ..... 399/31
2012/0300009 A1 * 11/2012 Toyoizumi et al. ..... 347/118
2013/0279927 A1 * 10/2013 Kihara et al. ..... 399/50
2013/0308969 A1 * 11/2013 Hasegawa et al. ..... 399/50
2014/0169815 A1 * 6/2014 Tetsuno et al. ..... 399/50

FOREIGN PATENT DOCUMENTS

JP 2002-296853 A 10/2002
JP 2008-8991 A 1/2008

* cited by examiner

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus including: photosensitive members; charging devices to which a common charging power source applies a charging voltage to charge the photosensitive members; an exposure device configured to expose the photosensitive members; developing devices to form developer images on the photosensitive members; a transfer device to transfer the developer images onto a transfer medium; and a control portion configured to set a lower limit value of the charging voltage for each photosensitive member, apply the charging voltage having a magnitude not less than any lower limit value from the charging power source to the charging devices, control the output of the laser power for each photosensitive member individually, and set, based on the image density of the developer image transferred onto the transfer medium earlier, the lower limit value for a photosensitive member on which a developer image to be transferred onto the transfer medium later is formed.

13 Claims, 13 Drawing Sheets

FIG. 12A AFTER PASSING TRANSFER POSITION
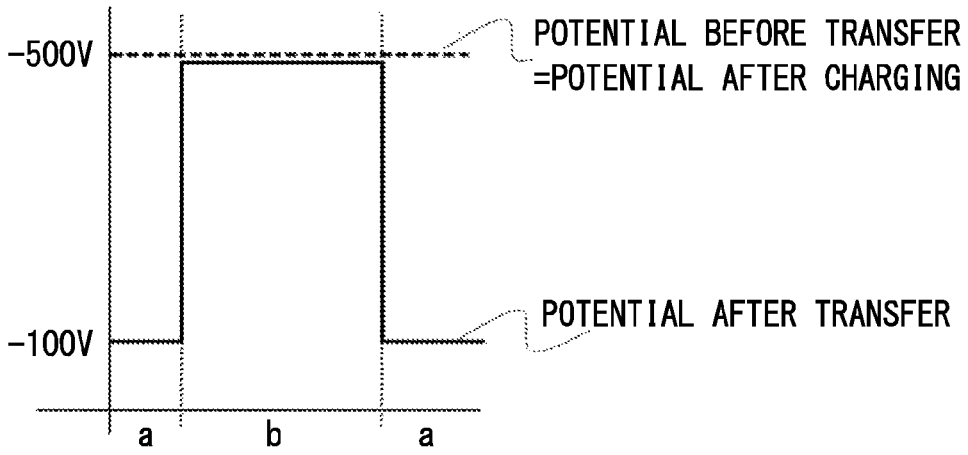
FIG. 12B AFTER PASSING CHARGING POSITION
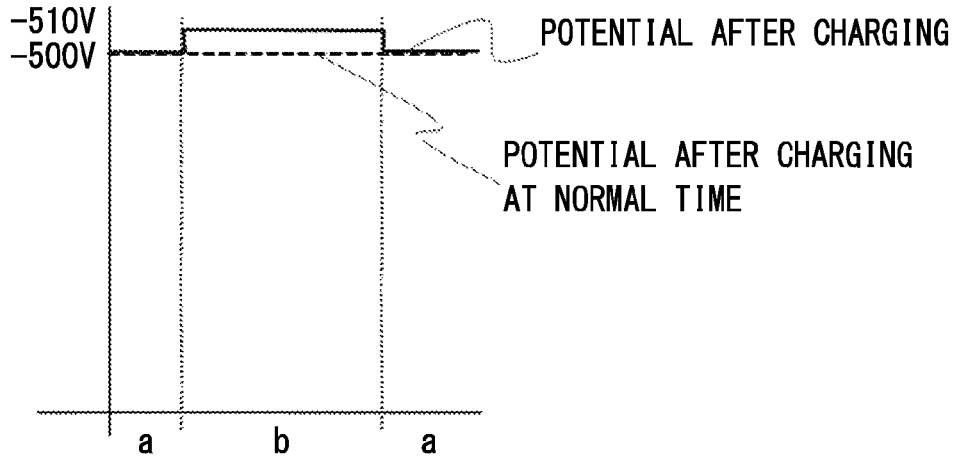
FIG. 12C AFTER PASSING EXPOSURE POSITION
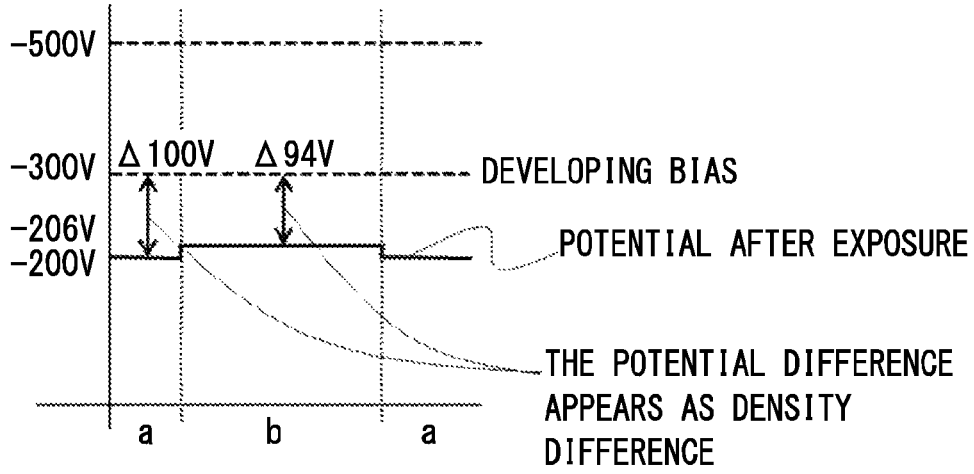

IMAGE FORMING APPARATUS WITH CONTROL OF CHARGING VOLTAGE OF PHOTOSENSITIVE MEMBER

BACKGROUND OF THE INVENTION

1. Field of the Invention

The present invention relates to an image forming apparatus using an electrophotographic system such as a copying machine or a printer.

2. Description of the Related Art

Up to now, a contact charging device, which has a system in which a voltage is applied to a charging member abutted against a photosensitive member to charge the photosensitive member, is put into practical use for an electrophotographic image forming apparatus because of having an advantage such as low ozone and low power. In particular, a device having a roller charging system using a charging roller as the charging member is preferred in terms of charging stability and is used widely.

In the contact charging device having the roller charging system, when a voltage (charge starting voltage Vth) equal to or higher than a fixed value is applied to the charging roller, a surface potential of the photosensitive member starts rising, and after that, increases linearly with an applied voltage at a slope of 1. That is, in order to obtain the surface potential (Vd) of the photosensitive member necessary for electrophotography, it is necessary to apply a DC voltage of Vd+Vth to the charging member.

Here, in a DC charging system, as a method of enhancing uniformity of the surface potential of the photosensitive member, the following conventional technology is proposed. Specifically, the photosensitive member is primarily charged to a potential equal to or higher than a non-image section potential (Vd) necessary for image formation temporarily, and a photosensitive member potential is exposed to weak light emitted from an exposure device (post-exposure device) located in a position after the primary charging and before developing, to thereby attenuate (lower) the surface potential. This is a potential control method of producing a target non-image section potential (Vd).

Here, Japanese Patent Application Laid-Open No. 2008-8991 proposes a method of setting a high primary charging potential based on a degree of non-uniformity (transfer memory) of the photosensitive member potential after the transfer, which is caused by presence/absence of a toner image and a transfer field strength, so as to increase a difference between the primary charging potential and the non-image section potential (Vd).

On the other hand, in the DC charging system, the charge starting voltage Vth changes depending on a photoconductive layer film thickness of the photosensitive member, and hence the non-image section potential (Vd) rises when a photosensitive member film thickness is reduced due to wear of the photosensitive member. Therefore, Japanese Patent Application Laid-Open No. 2002-296853 proposes a method of maintaining latent image potential setting at a constant level by calculating the photosensitive member film thickness from information on any one of the number of supplied sheets, the number of revolutions of the photosensitive member, and a charging voltage application period to control the exposure amount. According to this method, an image density, a line width, and a tone reproduction can be stably reproduced by changing ranges of a maximum light amount for forming an image section potential (Vl) and a minimum light amount for forming the non-image section potential (Vd) depending on the calculated photosensitive member film thickness. According to those conventional technologies, in a color image forming apparatus including a plurality of photosensitive members, a non-image section exposure amount for each of the photosensitive members is controlled based on the photosensitive member film thickness. With this control, even when voltages having a common value are applied to charging rollers configured to charge the respective photosensitive members, it is possible to obtain a constant non-image section potential (Vd). In addition, an image section exposure amount for forming the image section potential (Vl) is controlled based on the photosensitive member film thickness at the same time. With this control, commonality can be achieved among charging voltages for the plurality of photosensitive members and among developing voltages applied to developing devices configured to develop electrostatic latent images on the respective photosensitive members, which can downsize an apparatus and lower cost therefor.

However, in an image forming apparatus configured to form the non-image section potential (Vd) by performing non-image section exposure (background area exposure), the photosensitive member is repeatedly exposed over long-term use, to thereby cause reduction in sensitivity due to light-induced fatigue, which may cause an image failure such as a reduction in the image density. In other words, from the viewpoint of the reduction in the sensitivity of the photosensitive member, it is preferred that a background area exposure amount be as small as possible.

However, in a so-called inline color image forming apparatus in which the plurality of photosensitive members are arranged from upstream to downstream along a rotational direction of an intermediate transfer member, transfer memory exhibited by the photosensitive member of a downstream station in the primary transfer position may differ in magnitude depending on the image density in an upstream station. Therefore, when the image density is high in the upstream station, the difference between the primary charging potential and the non-image section potential (Vd) in the downstream station is set large. In other words, in order to obtain the primary charging potential higher than the non-image section potential (Vd) necessary for the image formation, the charging voltage is set high, and the background area exposure amount is set large.

Further, in a compact color image forming apparatus using a charging voltage common to the plurality of photosensitive members and a developing voltage common to a plurality of developing devices opposed to the plurality of photosensitive members, it is necessary to maintain the non-image section potential (Vd) at a constant level in all stations. Therefore, the background area exposure amount is set large in the station having the photosensitive member reduced in film thickness during use.

SUMMARY OF THE INVENTION

In view of the above-mentioned problems, an object of the present invention is to provide an image forming apparatus configured to form a stable surface potential of a photosensitive member by preventing an occurrence of a transfer memory image while suppressing a reduction in sensitivity of the photosensitive member.

In order to achieve the above-mentioned object, there is provided an image forming apparatus configured to form an image on a recording medium, the image forming apparatus comprising: a plurality of photosensitive members; a plurality of charging devices to which a common charging power source applies a charging voltage to charge the plurality of photosensitive members; an exposure device configured to expose surfaces of the plurality of photosensitive members, which have been charged by the plurality of charging devices, with a first laser power to form a non-image section potential, and expose the surfaces with a second laser power to form an image section potential; a plurality of developing devices to which a common developing power source applies a developing voltage to make developers adhere to areas in which the image section potential is formed to form developer images on the plurality of photosensitive members; a transfer device to which a transfer voltage is applied to transfer the developer images formed on the plurality of photosensitive members onto a transfer medium so as to sequentially superimpose the developer images on top of each other; and a control portion configured to control a magnitude of the charging voltage applied from the charging power source and an output of a laser power from the exposure device based on an image density of the developer image formed on each of the plurality of photosensitive members, wherein the control portion is configured to set a lower limit value of the charging voltage for each of the plurality of photosensitive members, apply the charging voltage having a magnitude not less than any lower limit value from the charging power source to the plurality of charging devices, and control the output of the laser power for each of the plurality of photosensitive members individually; and configured to set, based on the image density of the developer image transferred onto the transfer medium earlier, the lower limit value for a photosensitive member on which a developer image to be transferred onto the transfer medium later is formed.

Further features of the present invention will become apparent from the following description of exemplary embodiments with reference to the attached drawings.

BRIEF DESCRIPTION OF THE DRAWINGS

FIGS. 12A, 12B, and 12C are graphs illustrating a factor that causes a multiple color transfer ghost.

DESCRIPTION OF THE EMBODIMENTS

Now, exemplary embodiments for carrying out the present invention will be described in detail with reference to the accompanying drawings. However, a size, a material, and a shape of component parts described in the embodiment and a relative arrangement thereof should be changed appropriately depending on structures and configurations of an apparatus to which the invention is applied and various conditions therefor. In other words, it is not intended to limit the scope of the invention to the following embodiments.

Figure 2:
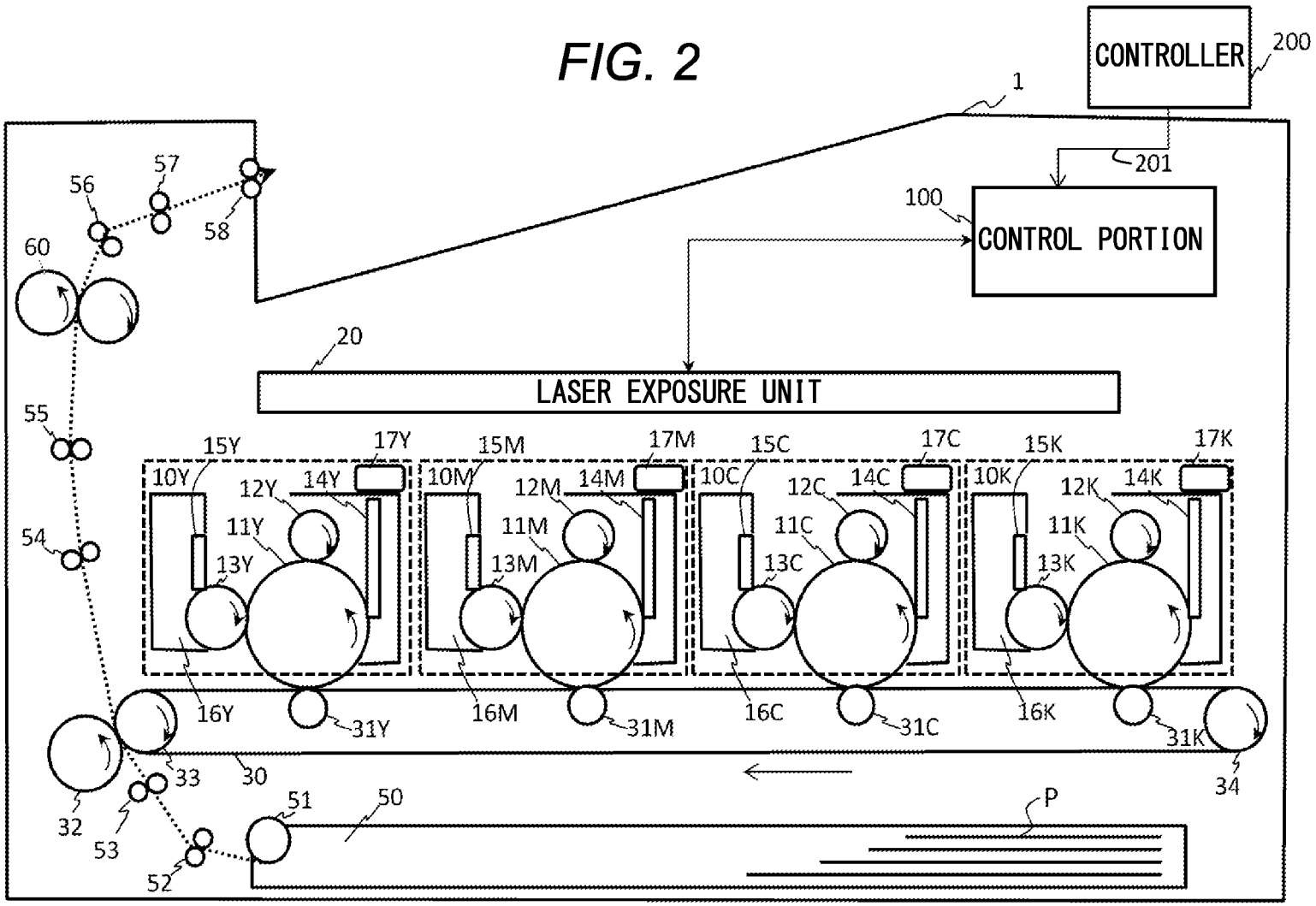
FIG. 2 is a schematic sectional view of an image forming apparatus according to an embodiment of the present invention.

First Embodiment (1-1) Description of Overall Schematic Structure and Configuration of Image Forming Apparatus FIG. 2 is a schematic sectional view of an image forming apparatus according to an embodiment of the present invention. An image forming apparatus 1 according to the embodiment of the present invention is a laser beam printer using an electrophotographic process. A printer control portion (hereinafter referred to as "control portion") 100 is connected to a printer controller (external host apparatus) 200 via an interface 201. The image forming apparatus 1 forms an image corresponding to image data (electrical image information) input from the printer controller (hereinafter referred to as "controller") 200 on a paper sheet P being a recording medium, and outputs an image-formed object. The control portion 100 is a unit configured to control an operation of the image forming apparatus, and exchanges various electrical information signals with the controller 200. Further, the control portion 100 administers processing of the electrical information signals input from various process devices and sensors, processing of instruction signals to be sent to the various process devices, predetermined initial sequence control, and predetermined image forming sequence control. Examples of the controller 200 include a host computer, a network, an image reader, and a facsimile machine. An OHP sheet, a postcard, an envelope, a label, and the like may be used as the recording medium instead of the paper sheet P.

The image forming apparatus 1 illustrated in FIG. 2 has a so-called inline-type structure in which four image forming units (process cartridges) 10Y, 10M, 10C, and 10K are arranged in parallel with each other at a regular interval in a lateral direction (substantially horizontal direction). The process cartridges 10Y, 10M, 10C, and 10K have suffixes Y, M, C, and K in their reference symbols, which indicate that colors of developers to be received (toner images to be formed) are different (Y represents yellow, M represents magenta, C represents cyan, and K represents black), but have the same structure. Therefore, in the following description, the suffixes are appropriately omitted from the reference symbols of the respective process cartridges 10Y, 10M, 10C, and 10K, components included therein, and components corresponding thereto when there is no need to particularly distinguish the colors.

The process cartridges 10Y to 10K are integrally formed of photosensitive drums 11Y to 11K, charging rollers 12Y to 12K, developing rollers 13Y to 13K, developing blades 15Y to 15K, and drum cleaners 14Y to 14K, respectively. The charging roller 12 is a charging unit (charging member or charging device) configured to uniformly charge a surface of the photosensitive drum 11 as an image bearing member to a predetermined potential. The developing roller 13 is a developing unit (developing member or developing device) configured to bear and carry non-magnetic one-component toner (negative chargeability) and develop an electrostatic latent image formed on the photosensitive drum 11 as a developer image (toner image). The developing blade 15 serves to level a toner layer on the developing roller. The drum cleaner (cleaning device) 14 serves to clean the surface of the photosensitive drum after the transfer. The photosensitive drum 11 is rotationally driven by a drive unit (not shown) in a direction indicated by the arrow in FIG. 2 at a surface moving speed (process speed) of 120 (mm/sec). Here, the photosensitive drum 11 is formed by stacking a charge generation layer, a charge transport layer, and a surface layer on an aluminum element tube in order. In the description of the embodiment, the charge generation layer, the charge transport layer, and the surface layer are referred to collectively as "photoconductive layer".

Here, the respective process cartridges 10Y to 10K are structured in substantially the same manner except for toner received in the respective developing containers 16Y to 16K. The process cartridges 10Y, 10M, 10C, and 10K form toner images in yellow (Y), magenta (M), cyan (C), and black (K), respectively. Further, the respective process cartridges 10Y to 10K are formed so as to be detachably attachable to an apparatus main body of the image forming apparatus 1. For example, the process cartridges 10Y to 10K are formed so as to be replaceable independently in a case where the toner within the developing container 16 has been consumed.

The respective process cartridges 10Y to 10K are provided with memories 17Y, 17K, 17C and 17K as storage units, respectively. As the memory 17, for example, an arbitrary form such as a contact non-volatile memory, a non-contact non-volatile memory, or a volatile memory having a power supply may be used. In the embodiment, a non-contact non-volatile memory 17 is mounted to the process cartridge as the storage unit. The non-contact non-volatile memory 17 includes an antenna (not shown) being an information transmission unit on a memory side, and can read and write information by communicating to/from the control portion 100 on the side of the apparatus main body of the image forming apparatus 1 by radio. In other words, the control portion 100 has functions of the information transmission unit on the side of the apparatus main body and a unit configured to read and write information to the memory 17. Information relating to a brand-new photosensitive drum is stored in the memory 17. Examples thereof include a brand-new photoconductive layer film thickness (initial photoconductive layer film thickness) and a brand-new sensitivity (initial sensitivity). Those pieces of information are stored at a time of manufacture. Further, information on the photosensitive member that changes over the use of the photosensitive drum (information relating to amounts of changes in the photoconductive layer film thickness and sensitivity) can be written and read as occasion arises.

The developing roller 13 serving as the developing unit includes a core and a conductive elastic layer integrally formed coaxially about the core, and is located substantially in parallel with the photosensitive drum 11. The developing blade 15 is formed of a sheet metal made of SUS, and has a free end abutted against the developing roller 13 with a predetermined pressing force. The developing roller 13 bears and carries toner charged to a negative polarity by friction to a developing position opposed to the photosensitive drum. The developing roller is structured to be able to be abutted against and spaced apart from the photosensitive drum 11 by a contact-separation mechanism (not shown). In an image forming step, the developing roller 13 is abutted against the photosensitive drum 11, and has a DC bias voltage of approximately −300 V applied as a developing bias voltage to the core of the developing roller 13 from a developing bias power supply (developing power source) 601 described later with reference to FIG. 4.

The image forming apparatus 1 according to the embodiment is provided with, as an exposure unit (exposure device or exposure member), a laser exposure unit 20 configured to expose the photosensitive drum 11 disposed in each of the process cartridges 10Y to 10K. A time-series electric digital pixel signal of image information, which is input from the controller 200 to the control portion 100 via the interface 201 to be subjected to image processing, is input to the laser exposure unit 20. The laser exposure unit 20 includes a laser output portion configured to output laser light modulated correspondingly to the input time-series electric digital pixel signal, a rotary polygonal mirror (polygon mirror), an fθ lens, and a reflecting mirror, and uses laser light L illustrated in FIG. 4 to mainly scan and expose the surface of the photosensitive drum 11. The electrostatic latent image corresponding to the image information is formed by the main-scanning exposure and sub-scanning due to rotation of the photosensitive drum 11.

Here, the charging roller 12 serving as a contact-type charging unit includes a core and a conductive elastic layer integrally formed coaxially about the core, is located substantially in parallel with the photosensitive drum 11, and is abutted against elasticity of the conductive elastic layer with a predetermined pressing force. Both end portions of the core are rotatably supported to bearings, and the charging roller 12 is driven to rotate by the rotation of the photosensitive drum 11. In the embodiment, a charging bias voltage is applied to the core of the charging roller 12.

On the other hand, in the image forming apparatus 1 according to the embodiment, an intermediate transfer belt 30 being a second image bearing member or a transfer medium is located so as to be abutted against the photosensitive drums 11 of the respective process cartridges 10Y to 10K. A resin film, which is formed to have an endless shape and has an electric resistance value (volume resistivity) of approximately $10^{11}$ to $10^{16}$ (Ω·cm) and a thickness of 100 to 200 μm, is used as the intermediate transfer belt 30. It is possible to use polyvinylidene difluoride (PVDF), nylon, polyethylene terephthalate (PET), polycarbonate (PC), or the like as a material for the intermediate transfer belt 30. Further, the intermediate transfer belt 30 is stretched around a drive roller 34 and a secondary transfer opposing roller 33, and is circulatingly conveyed at a process speed by the secondary transfer opposing roller 33 being rotated by a motor (not shown). Primary transfer rollers 31Y, 31M, 31C and 31K are each formed to have a roller shape having a conductive elastic layer provided onto a shaft, are arranged substantially in parallel with the photosensitive drums 11Y to 11K, respectively, and are abutted against the photosensitive drums 11Y to 11K, respectively, via the intermediate transfer belt 30 with a predetermined pressing force. A DC bias voltage having a positive polarity as a transfer voltage is applied to the shaft of the primary transfer roller 31 to thereby form a transfer field.

The toner images in the respective colors, which have been developed onto the respective photosensitive drums 11, are each conveyed to a primary transfer position by further rotation of the photosensitive drum 11 in the direction indicated by the arrow, and are primarily transferred onto the intermediate transfer belt 30 in order by a primary transfer field formed between the primary transfer roller 31 and the photosensitive drum 11. In this case, the images in the four colors are transferred onto the intermediate transfer belt 30 in order in a superimposed manner, and hence the toner images in the four colors coincide in position with one another. Residual toner of the primary transfer on the photosensitive drum 11 is cleaned by the drum cleaner 14. The primary transfer rollers 31Y to 31K are transfer units (transfer members or transfer devices) for transferring the developer images (toner images) formed on the respective photosensitive drums 11 onto the transfer medium (intermediate transfer belt 30).

Figure 4:
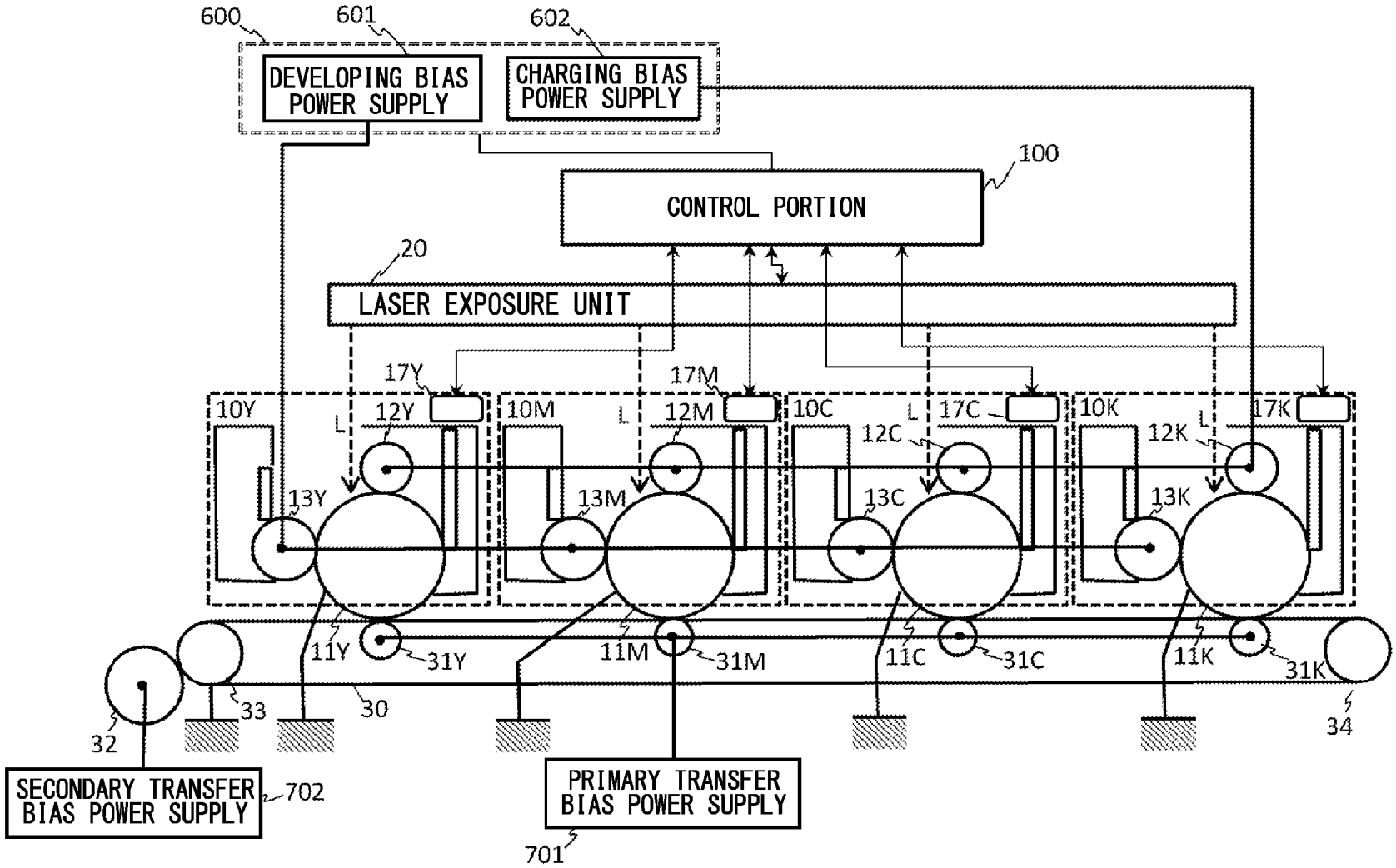
FIG. 4 is a diagram illustrating power supply wirings according to the embodiment of the present invention.

Note that, in order to satisfactorily perform a primary transfer step at all times while satisfying conditions such as high transfer efficiency and low re-transfer rate, it is necessary to constantly control the bias of the positive polarity applied by a primary transfer bias power supply 701 illustrated in FIG. 4 to maintain an optimum value in consideration of an environment, characteristics of parts, and the like. In the embodiment, such control is performed by the control portion 100 illustrated in FIG. 2.

Here, as a sheet conveying system for the image forming apparatus 1 according to the embodiment, a sheet cassette 50, a pick-up roller 51, conveying rollers 52, and registration rollers 53 are arranged on a sheet feeding side. The sheet cassette 50 receives the paper sheets P. The pick-up roller 51 picks up and conveys one of the paper sheets P being recording mediums stacked in the sheet cassette 50 at a predetermined timing. The conveying rollers 52 convey the paper sheet P forwarded by the pick-up roller 51. The registration rollers 53 send out the paper sheet P to a secondary transfer position at a timing corresponding to an image forming operation.

After the toner images in the four colors have been primarily transferred onto the intermediate transfer belt 30, the paper sheet P is conveyed from a portion of the registration rollers 53 in synchronization with the rotation of the intermediate transfer belt 30. Then, a secondary transfer roller 32 having the same structure as the primary transfer roller 31 is abutted against the intermediate transfer belt 30 via the paper sheet P. A positive polarity bias is applied from a secondary transfer bias power supply 702 illustrated in FIG. 4 to the secondary transfer roller 32 with the secondary transfer opposing roller 33 as a counter electrode, and the toner images in the four colors on the intermediate transfer belt 30 are secondarily transferred collectively onto the paper sheet P. Residual toner of the secondary transfer is given a positive polarity charge by a bias applied by a charging brush (not shown) abutted against the intermediate transfer belt 30, and is therefore transferred onto a side of the photosensitive drum 11 in the primary transfer position for the image forming step, to be scraped and collected by the drum cleaner 14. Note that, in the embodiment, the toner images are primarily transferred from the photosensitive drums 11 onto the intermediate transfer belt 30 temporarily, and after that, secondarily transferred from the intermediate transfer belt 30 onto the paper sheet P. However, it is also conceivable to employ a structure in which the toner image is directly transferred from the photosensitive drum 11 onto the paper sheet P. In this case, a recording medium conveyor belt is used in place of the intermediate transfer belt 30. That is, the paper sheet P (recording medium) is conveyed by the recording medium conveyor belt to the positions of the respective photosensitive drums 11, and the toner images in the respective colors are sequentially transferred from the respective photosensitive drums 11 onto the conveyed paper sheet P so as to be superimposed on each other. In this case, the recording medium (paper sheet P) serves also as the transfer medium onto which the toner images are transferred from the photosensitive drum 11 by the primary transfer rollers 31Y to 31K.

The paper sheet P onto which the toner images in the four colors have been transferred are conveyed by conveying rollers 54 and 55 to a fixing device 60 known up to now, and the unfixed toner images on the paper sheet P are subjected to fixing processing using heat and pressure, to thereby be fixed to the paper sheet P. The paper sheet P is delivered as a color-image-formed object from a delivery port through delivery rollers 56, 57, and 58 onto a delivery tray on a top surface of the apparatus main body.

(1-2) Description Relating to Laser Exposure Unit

Figure 11:
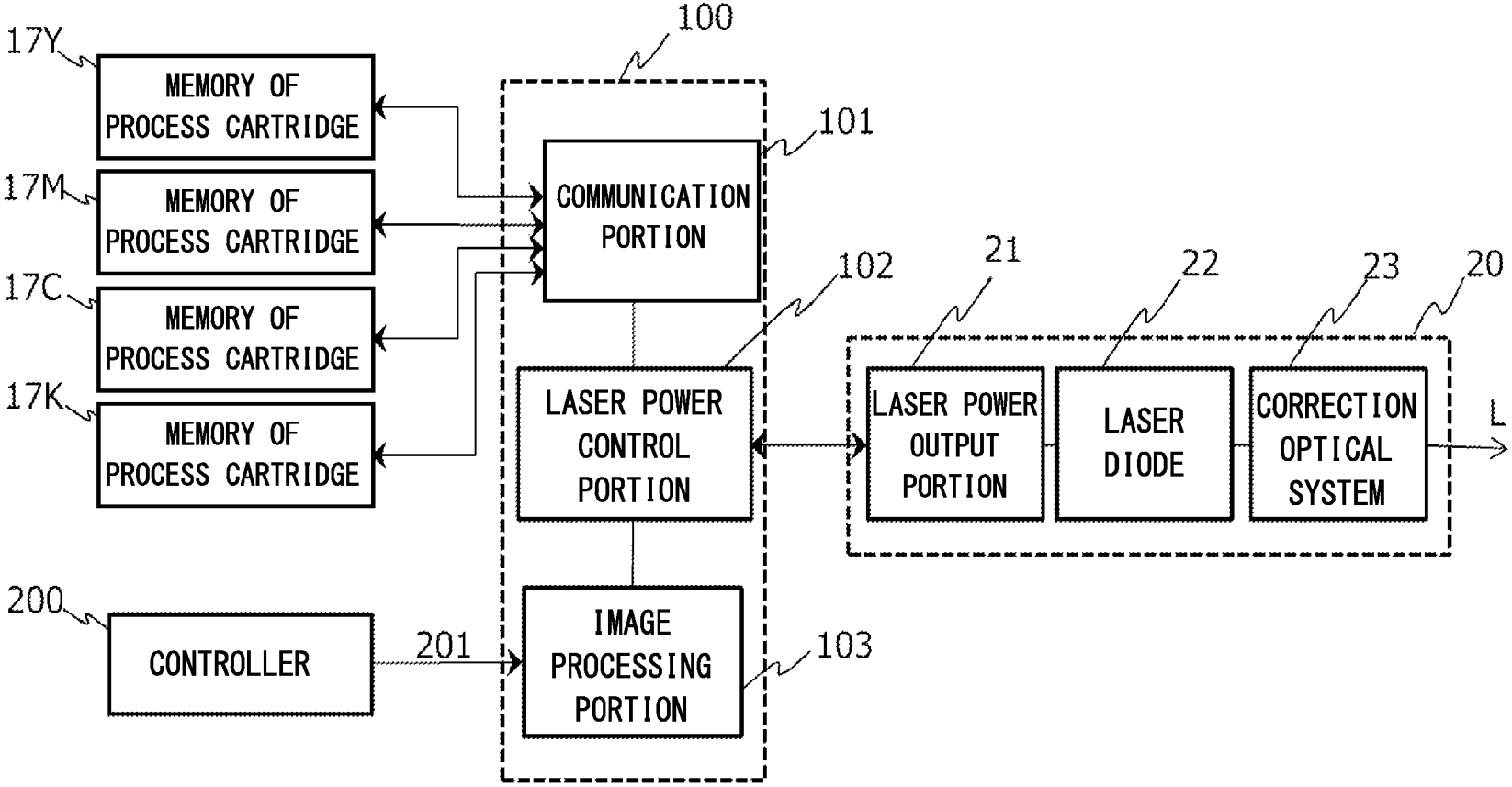
FIG. 11 is a block diagram relating to a laser power control system.

With reference to FIG. 11, the laser exposure unit according to the embodiment will be described. FIG. 11 is a block diagram relating to a laser power control system. Here, the laser exposure unit 20 according to the embodiment is configured to be able to switch and output two-level output values of a first laser power (E1) and a second laser power (E2) as laser outputs used to expose a photosensitive member surface. In other words, the control portion 100 is provided with a laser power control portion 102 configured to separately control the respective laser powers. An image signal sent from the controller 200 is a multi-valued signal (0 to 255) having a depth direction of 8 bits=256 levels of gray. It is assumed that the laser light is off when this signal is 0, is completely on when the signal is 255 (fully lit), and exhibits a value between the both for a short while when the signal is between 1 and 254. In the embodiment, in an image processing portion 103, the signal is converted into a serial time-series digital signal, and is controlled at 256 levels by using a laser pulse width modulation for controlling an area coverage modulation based on a 4-by-4 dither matrix and a laser light emission period of each of dot pulses of 600 dots/inch. Further, in the image processing portion 103 serving as an image information obtaining unit, it is possible to obtain image density data corresponding to the respective colors. For example, when the image signal within a given area of the image is yellow (Y): 255 and magenta (M): 255, it is recognized that a multiple color coverage rate for the given area is 200%. Further, a communication portion 101 reads information relating to photosensitive member film thickness and sensitivity, which is stored in the memories 17Y to 17K of the respective process cartridges. A laser power signal selected based on a state of a photosensitive member of each of the process cartridges and an image data signal for each of the process cartridges are sent from the laser power control portion 102 to the laser exposure unit 20. A laser power output portion 21 switches over the laser power based on a selection signal input from the laser power control portion 102, and causes a laser diode 22 to emit light, to thereby irradiate the photosensitive drum 11 with laser scanning light L through a correction optical system 23 including the polygon mirror.

The laser power control portion 102 according to the embodiment separately controls the first laser power (E1) and the second laser power (E2) for each process cartridge. The first laser power (E1) is a laser power for forming a dark section potential (non-image section potential Vd) with respect to a non-image area. The second laser power (E2) is a laser power for forming a light section potential (image section potential Vl) with respect to an image area. In the embodiment, in the image forming step, a laser is caused to emit weak light by keeping a predetermined bias current flowing through the laser diode 22, which is set as the first laser power (E1). Further, the second laser power (E2) is obtained by adding a current value to the flowing bias current with respect to an image section. Further, the laser power control portion 102 sets a current amount flowing through the laser diode 22 to be variable based on photosensitive member surface potential control described later, to thereby control (adjust) the laser powers E1 and E2.

(1-3) Description Relating to Latent Image Setting

Figure 3A:
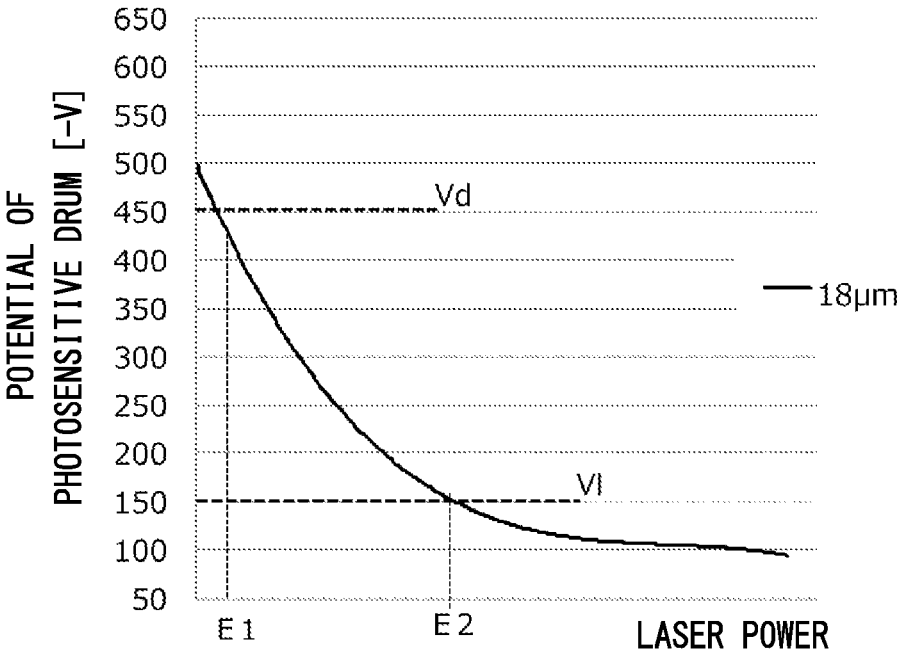
FIGS. 3A and 3B are explanatory diagrams of latent image setting according to the embodiment of the present invention.
Figure 3B:
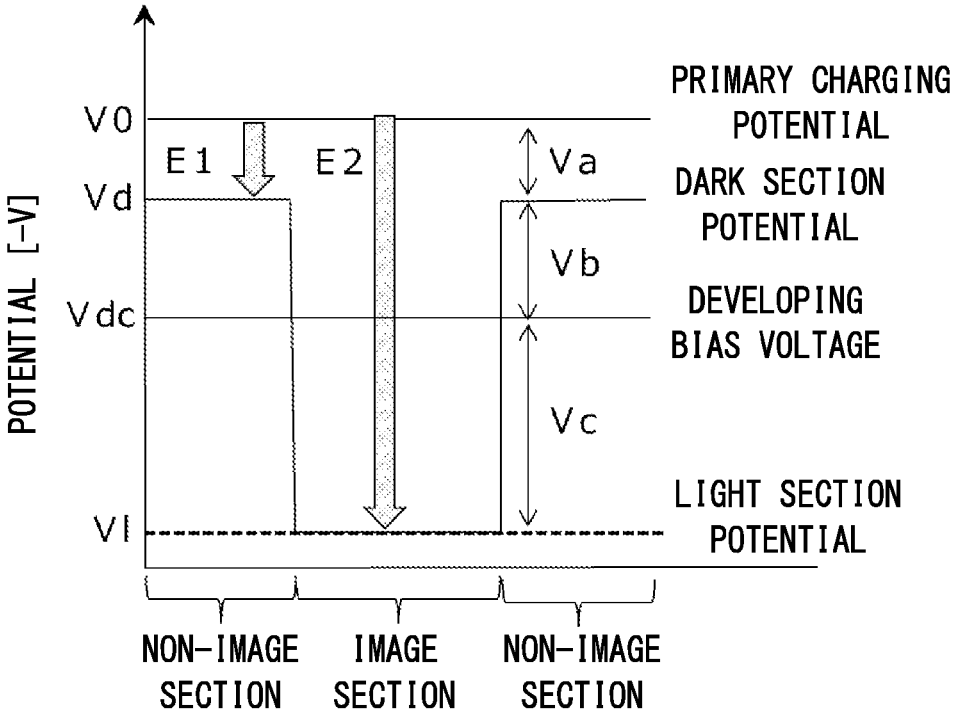

With reference to FIG. 3A and FIG. 3B, latent image setting according to the embodiment will be described. The photosensitive drum 11 according to the embodiment is formed of a cylindrical base made of aluminum and an organic photoconductor (OPC) layer (photoconductive layer) which covers a surface of the base.

FIG. 3A is a graph illustrating a relationship (hereinafter referred to as "E-V curve") between a surface potential and an exposure laser power obtained when a DC voltage of approximately −1,040 (V) is applied to the charging roller 12 with respect to the photosensitive drum 11 whose photoconductive layer has a film thickness of 18 (μm). The horizontal axis of the graph represents an exposure laser power E (μJ/cm$^2$) to which the photosensitive member surface is subjected. The laser exposure unit 20 exposes the image section of the photosensitive drum 11 with the second laser power E2 (μJ/cm$^2$), to thereby form the light section potential (Vl) of approximately −150 (V). At the same time, the laser exposure unit 20 exposes a non-image section (background) with the first laser power E1 (μJ/cm$^2$), to thereby form the dark section potential (Vd) of approximately −440 (V). Further, the DC bias voltage of approximately −300 (V) is applied to the developing roller. Therefore, negatively charged toner conveyed to the developing position adheres to a part of the light section potential (Vl) due to a potential contrast between the light section potential (Vl) and a developing bias voltage (Vdc) on the photosensitive drum 11, and the electrostatic latent image is reversal-developed as the toner image.

Note that, the image forming apparatus 1 according to the embodiment uses a reversal development method which uses the negative polarity (negative) charge to perform the charging of the photosensitive drum 11 by the charging roller 12 and uses the toner (negatively) charged to the negative polarity to perform the development. Therefore, an area exposed with the second laser power E2 (μJ/cm$^2$) is the image section, while an area exposed with the first laser power E1 (μJ/cm$^2$) is a white background section (background) being the non-image section.

FIG. 3B is a graph illustrating potential setting. The development contrast (Vc) indicating a difference between the light section potential (Vl) and the developing bias voltage (Vdc) becomes a factor for setting an image density and a tone reproduction of the image section. In other words, when the development contrast (Vc) becomes small, it is not possible to obtain sufficient image density and tone reproduction. Therefore, the development contrast (Vc) needs to ensure a value equal to or larger than a predetermined value. In the embodiment, the development contrast Vc is set to 150 (V). Further, a white background section contrast (Vb) being a difference between the developing bias voltage (Vdc) and the dark section potential (Vd) is a factor for determining a fogging (ground stain) amount within the white background section. In other words, when the white background section contrast (Vb) becomes large to exceed the predetermined value, the reversely charged toner (in other words, positively charged toner) adheres to the white background section to form fogging, which causes an image stain, an in-machine contamination, or the like. On the other hand, when the white background section contrast (Vb) becomes small below a predetermined value, the normally charged toner (in other words, negatively charged toner) develops in the white background section to form fogging. Therefore, the white background section contrast (Vb) needs to be set within a predetermined range. In the embodiment, the white background section contrast Vb is set to 150 (V). Further, a dark section contrast (Va) being a difference between a primary charging potential (V0) and the dark section potential (Vd) is set to ensure a value equal to or larger than a value necessary to prevent an occurrence of a so-called multiple color transfer ghost caused by non-uniformity of the surface potential of the photosensitive drum after the primary transfer. The multiple color transfer ghost will be described in detail below.

(1-4) Description Relating to Multiple Color Transfer Ghost

The multiple color transfer ghost is a defective image formed when the potential of the photosensitive drum 11 in a downstream station is disturbed under the influence of the toner image formed in an upstream station. This is because, in a primary transfer step performed by the downstream station, the amount of a transfer current flowing into the photosensitive member differs between the part including a toner image and the part which does not include the toner image, to thereby cause the non-uniformity of the potential on the photosensitive member after the transfer. A charging step is not enough to achieve uniformity of the non-uniform potential after the transfer, which causes a phenomenon that a ghost image appears on the image.

This phenomenon will be described in detail below.

When a color image is printed, a desired color is output by superimposing a plurality of colors on each other. For example, a plurality of colors are superimposed on each other in such a manner that yellow (Y) and magenta (M) are used to print a red color, magenta (M) and cyan (C) are used to print a blue color, and yellow (Y) and cyan (C) are used to print a green color. Such image formation is performed in the stations for yellow 10Y, magenta 10M, and cyan 10C. Therefore, when the image is formed by a black 10K station, the toner images in yellow (Y), magenta (M), and cyan (C) already exist on the intermediate transfer belt 30. In this manner, in an area in which a large volume of toner in a plurality of colors is superimposed on the intermediate transfer belt 30 (hereinafter referred to as "multiple color section"), the transfer current flowing from the primary transfer roller 31 into the photosensitive drum 11 via the intermediate transfer belt 30 becomes extremely small. Therefore, a large difference occurs in the surface potential of the photosensitive drum after passing a primary transfer position because of a difference in the current amount flowing through the part in which the multiple color section or the toner does not exist.

FIGS. 12A, 12B, and 12C illustrate the potential of the surface of the photosensitive drum 11 within the black 10K station. In FIGS. 12A, 12B, and 12C, the "a" part indicates a part in which the toner does not exist, and the "b" part indicates the potential in the multiple color section. In the multiple color section, a red patch is printed, and the image density data on both yellow (Y) and magenta (M) has a coverage rate of 200%. FIG. 12A illustrates the potential of the photosensitive drum 11 after passing through the primary transfer position. The potential in the "a" part has changed from the potential before the primary transfer to approximately −100 (V). In contrast, the potential in the "b" part has changed slightly but not greatly from the potential before the primary transfer. When the charging step is performed in this state, as illustrated in FIG. 12B, the potential becomes higher in the "b" part than in the "a" part by approximately 10 (V). Subsequently, when an entire area is exposed in order to form a halftone density in an exposure step, the above-mentioned difference is slightly reduced as illustrated in FIG. 12C, but a potential difference of approximately 6 (V) remains. When a developing step is performed in the above-mentioned state in which the potential difference remains, a difference occurs in the amount of the toner transferred from the developing roller to the photosensitive drum 11 correspondingly to the potential difference. Finally, the difference in toner amount appears as a density difference on the image, which causes the ghost image (multiple color transfer ghost) in which the density becomes higher in the "b" part than in the "a" part. That is, the photosensitive drum 11 for black is brought into contact with a red toner image formed by the upstream stations (here, stations for yellow and magenta) on the intermediate transfer belt 30 in the first rotation for image formation. As a result, the toner image formed on the intermediate transfer belt 30 by the photosensitive drum 11 for black in the second rotation becomes lighter in the part brought into contact with the red toner image in the first rotation.

Next, the cause of the multiple color transfer ghost will be described in detail below.

Figure 8:
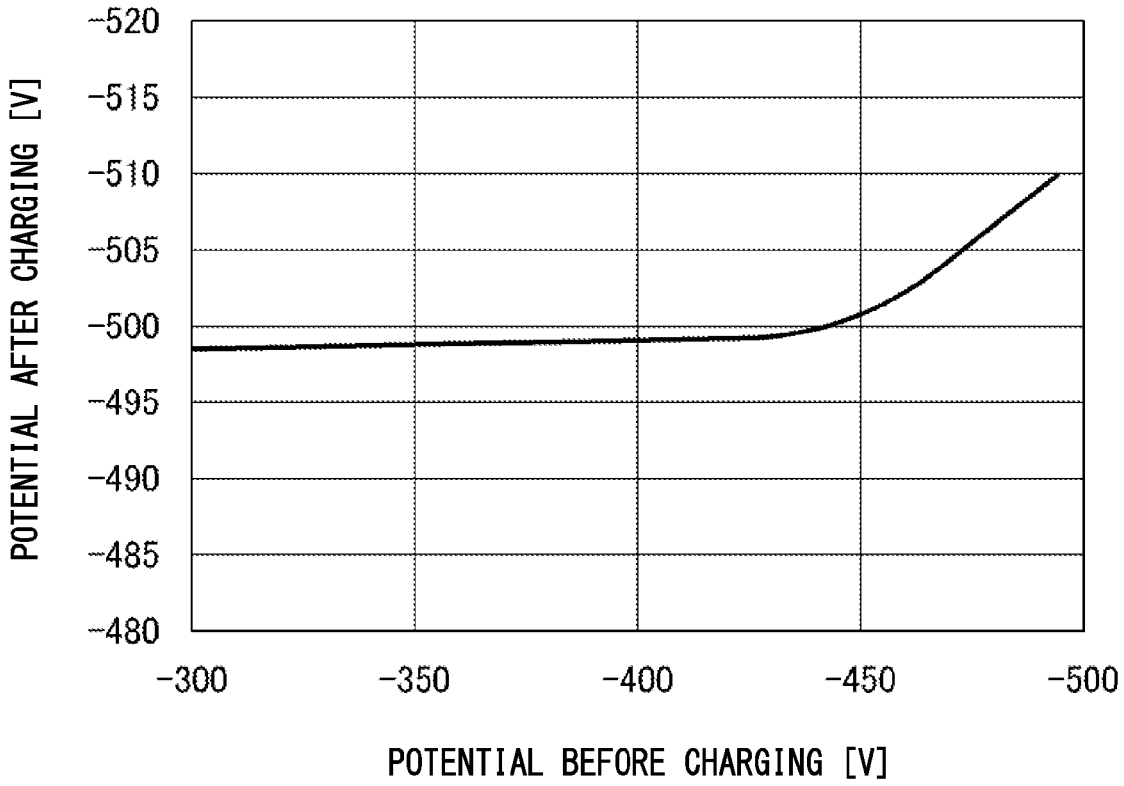
FIG. 8 is a graph illustrating a relationship between a potential before charging and a potential after the charging.

FIG. 8 is a graph illustrating a relationship between a potential before the charging and a potential after the charging of the surface of the photosensitive drum 11, which was obtained through studies by the inventors of the present invention. In an experiment, the surface potential of the photosensitive drum was measured when −1,040 (V) was applied to a charging voltage in an environment at a temperature of 25 degrees centigrade and a relative humidity of 50%. Referring to FIG. 8, it is understood that the potential after the charging is unstable when the potential before the charging is close to the potential after the charging. Roughly, the potential after the charging is relatively stable at approximately −498 to −500 (V) when the potential before the charging is equal to or smaller than approximately −440 (V). However, when the potential before the charging exceeds −440 (V), the potential gradually rises above −500 (V), which is a target potential after the charging. That is, the potential after the charging is stable when a difference between the target potential after the charging and the potential before the charging is equal to or larger than approximately 60 (V), and the charging potential has a higher value as the difference becomes smaller below approximately 60 (V). A phenomenon that the potential rises above the target potential after the charging is referred to as "overcharging".

As described above, multiple color toner transfer memory is caused by the fact that the overcharging phenomenon occurs to cause a difference in the potential after the charging because the surface potential of the photosensitive drum before the charging in the part including the toner maintains substantially the same potential as the potential after the charging.

Next, a measure for suppressing the multiple color transfer ghost will be described in detail below.

Figure 13A:
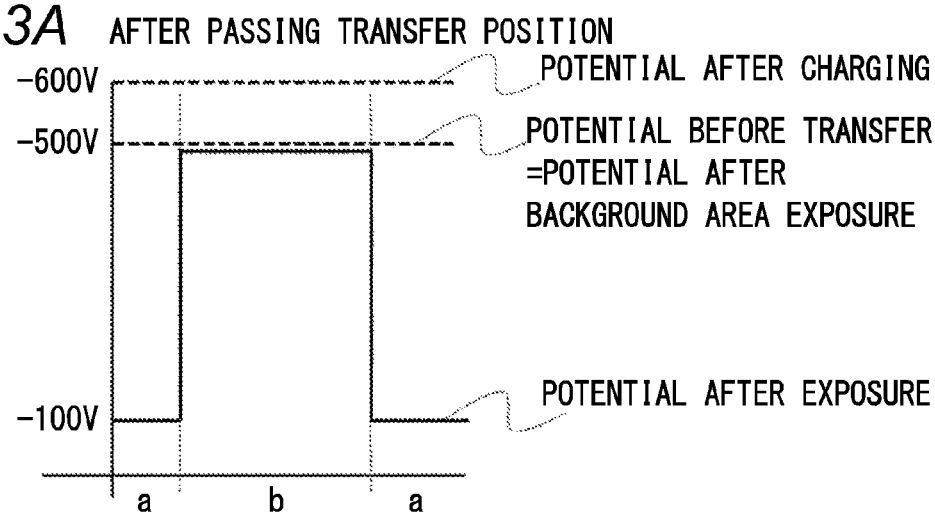
FIGS. 13A, 13B, and 13C are graphs illustrating control for the latent image setting according to the embodiment of the present invention.
Figure 13B:
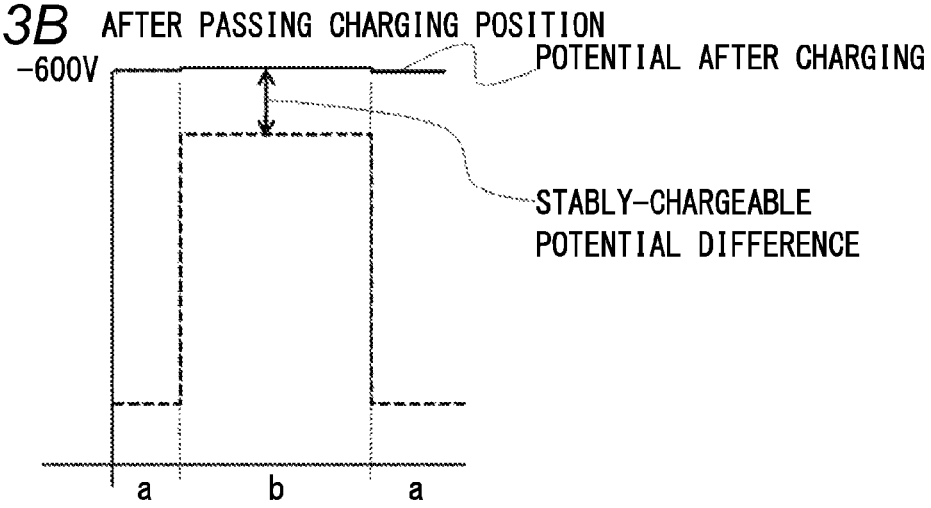
Figure 13C:
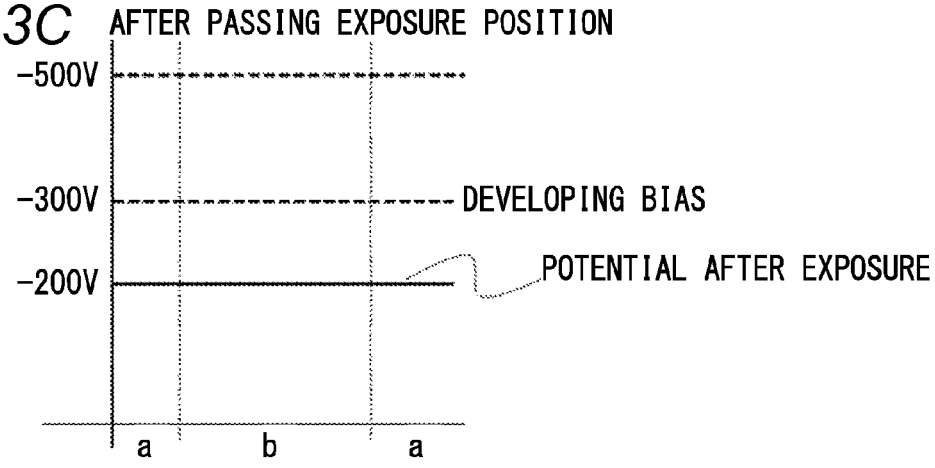

FIGS. 13A, 13B, and 13C illustrate the potential of the surface of the photosensitive drum 11 within the black 10K station in the same manner as in FIGS. 12A to 12C. As illustrated in FIG. 13A, the photosensitive drum surface is primarily charged to −600 (V), and background exposure is performed in the exposure step, to thereby form a surface potential of −500 (V). At this time, the potential of the photosensitive drum 11 after passing through the primary transfer position is substantially the same potential as in FIG. 12A, and a large potential difference occurs between the "a" part and the "b" part. FIG. 13B illustrates the potential of the photosensitive drum 11 after passing through a position for the charging step. There is a potential difference between the "a" part and the "b" part before the charging, but also in the "b" part, there is a sufficient potential difference from the target primary charging potential. Therefore, it is possible to perform uniform charging, and the primary charging potential is substantially uniform. It should be understood that, as illustrated in FIG. 13C, the potential is uniform even after the exposure for forming the halftone density is performed in the exposure step, which prevents the density difference (ghost image) from appearing even in the final image.

Note that, the inventors of the present invention found that, as shown below in Table 1, there is a correlation between the coverage rate for the multiple color section and the multiple color transfer ghost. This finding was obtained by examining an occurrence level of the multiple color transfer ghost in the black 10K station when red images different in the coverage rate were printed. In this case, a change in the occurrence level of the multiple color transfer ghost was examined while changing the dark section contrast by changing the primary charging potential with the non-image section potential Vd fixed to −440 (V). As apparent from results thereof, when the coverage rate for the multiple color section exceeds 100%, the multiple color transfer ghost starts to occur, exhibiting a tendency that a ghost occurs more conspicuously as the coverage rate becomes higher. In contrast, also in a case of a maximum coverage rate of 200%, the uniform charging can be performed by ensuring the dark section contrast Va=60 (V) by the background area exposure, and it was found that the occurrence of the multiple color transfer ghost can be suppressed.

TABLE 1

| Coverage rate for multiple color | Dark section contrast (Va) 0 (V) | 20 (V) | 40 (V) | 60 (V) |
|---|---|---|---|---|
| 80% or larger | ○ | ○ | ○ | ○ |
| 100% or larger | Δ | ○ | ○ | ○ |
| 140% or larger | x | Δ | ○ | ○ |
| 200% or larger | xx | x | Δ | ○ |

○: Does not occur
Δ: Occurs slightly
x: Occurs
xx: Occurs conspicuously

Here, further optimal charging potential setting is enabled by providing such a configuration that the image density data can be acquired for each developer image formed on each photosensitive drum and by setting the charging potential of the photosensitive member in the downstream based on an integrated value of the image density data on all the developer images on the upstream side. A transfer ghost occurs as the ghost image for C when a red image section, in which, for example, a total image density of an image formed by superimposing Y: 70% and M: 70% on each other is 140% (image section having a large developed mass per unit area), passes through the station for C. The transfer ghost occurring at C changes in occurrence degree depending on a maximum value (maximum value of the developed mass per unit area) of the image densities of images formed by the stations existing in the upstream (Table 1). Therefore, if the maximum value of the image densities in the stations on the upstream side can be detected as the image density data, it is possible to obtain the optimal dark section contrast (Va) based on the detected value and possible to set a minimum necessary charging voltage Vp.

(1-5) Description Relating to E-V Characteristic of Photosensitive Member

Next, a change characteristic of the E-V curve of the photosensitive drum will be described with reference to FIG. 5A, FIG. 5B, FIG. 6A, FIG. 6B, and FIG. 10A.

Figure 5A:
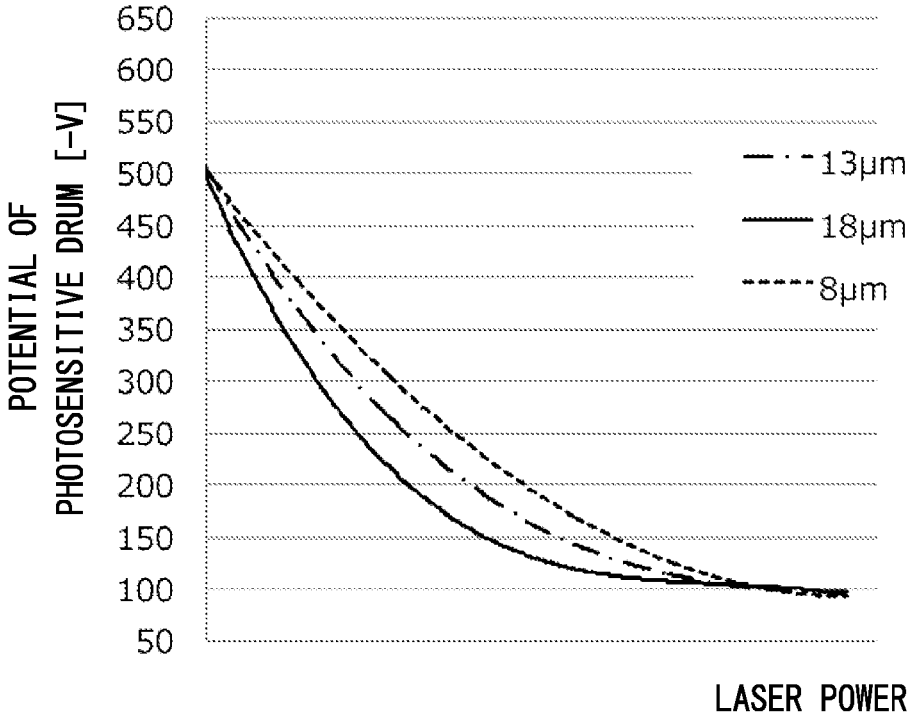
FIGS. 5A and 5B are graphs illustrating a relationship between a photoconductive layer film thickness of a photosensitive drum and an E-V curve.

The photoconductive layer of the surface of the photosensitive drum 11 is repeatedly subjected to discharging along with the print operation, and the surface is abraded by being rubbed by the drum cleaner 14 and the developing roller 13. As a result, the photoconductive layer is reduced in the film thickness, and a surface potential characteristic thereof changes. FIG. 5A illustrates E-V curves obtained when the primary charging potential of the photosensitive drum surface is caused to be uniform by adjusting the respective charging bias voltages for the photosensitive drums different in the film thickness. As the film thickness decreases, a surface charge density increases, and thereby a slope of the E-V curve becomes smaller. In other words, a photosensitive member potential changes depending on a film thickness change over time of the photoconductive layer and the photoconductive layer film thickness (initial film thickness) at the time of manufacture.

Figure 5B:
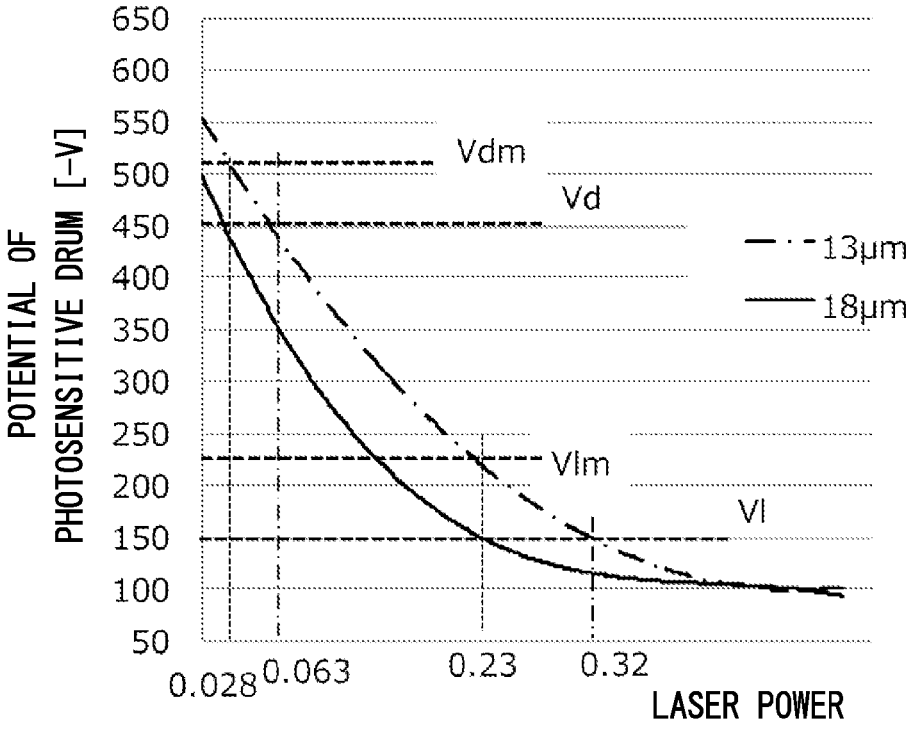

Further, when the output value of the charging bias is fixed to a predetermined value, the primary charging potential rises along with the above-mentioned film thickness change of the photoconductive layer. This is because a discharge starting voltage between the charging roller and the photosensitive drum becomes smaller as an electrostatic capacity increases. FIG. 5B illustrates E-V curves obtained when the photosensitive drums different in the film thickness of the photoconductive layer are charged with the charging voltage fixed to a predetermined value. Specifically, FIG. 5B illustrates the E-V curves of the photosensitive drum whose photoconductive layer has a film thickness of 18 (μm) and the photosensitive drum whose photoconductive layer has a film thickness of 13 (μm) with the output value of the charging bias voltage fixed to −1,040 (V). By the change in the film thickness of the photoconductive layer, the primary charging potential rises, and a change occurs in the slope of the E-V curve. When the film thickness of the photoconductive layer is 18 (μm), laser exposure output values for obtaining a desired dark section potential Vd=−440 (V) and a desired light section potential Vl=−150 (V) are E1=0.028 (μJ/cm$^2$) and E2=0.23 (μJ/cm$^2$), respectively. In this case, it is understood that, if a print test is performed until the film thickness of the photoconductive layer becomes 13 (μm) without changing the laser exposure output value with the constant charging voltage, the dark section potential (Vd) and the light section potential (Vl) both deviate from the target values to become Vdm and Vlm, respectively. Therefore, it is preferred that laser exposure amounts E1 and E2 be adjusted based on the photoconductive layer film thickness.

Figure 6A:
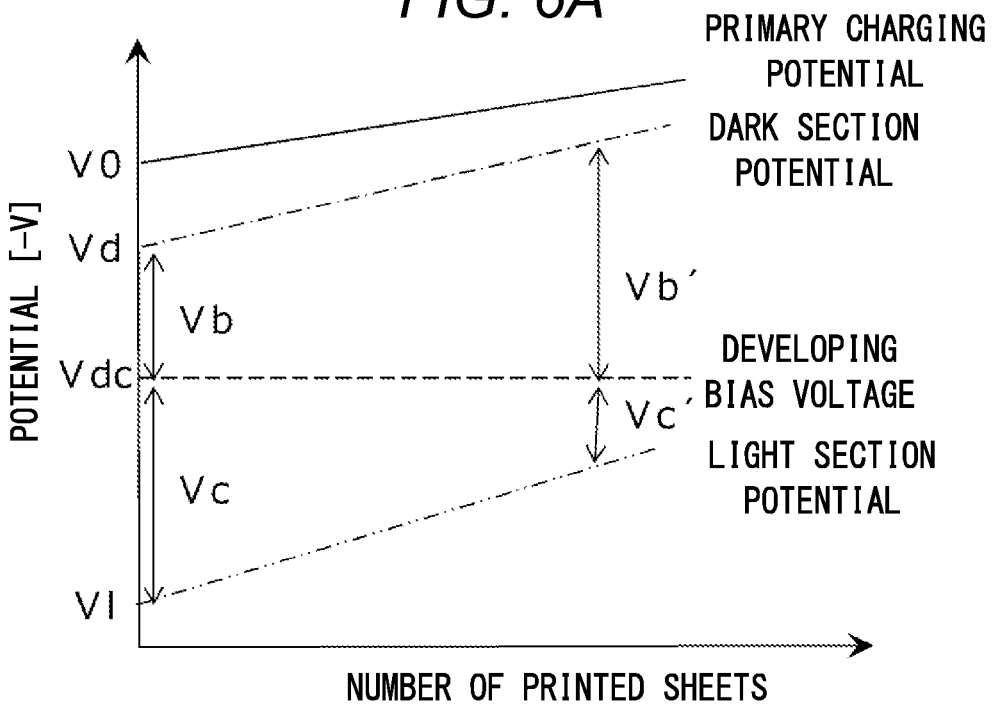
FIGS. 6A and 6B are graphs illustrating transitions of potentials based on use information on the photosensitive drum.

FIG. 6A is a graph schematically illustrating transitions of the potentials Vd and Vl exhibited in a case where the laser exposure output value is not changed based on use information on the photosensitive drum with the charging voltage and a developing voltage fixed. The number of printed sheets is used as a use amount of the photosensitive drum. As described above, the E-V curve changes along with the film thickness change of the photoconductive layer, and thereby the dark section potential (Vd) and the light section potential (Vl) rise. As a result, a white background section contrast (Vb') increases, a development contrast (Vc') decreases, and image quality including the image density, the fogging, the line width, and the tone reproduction deteriorates.

Figure 6B:
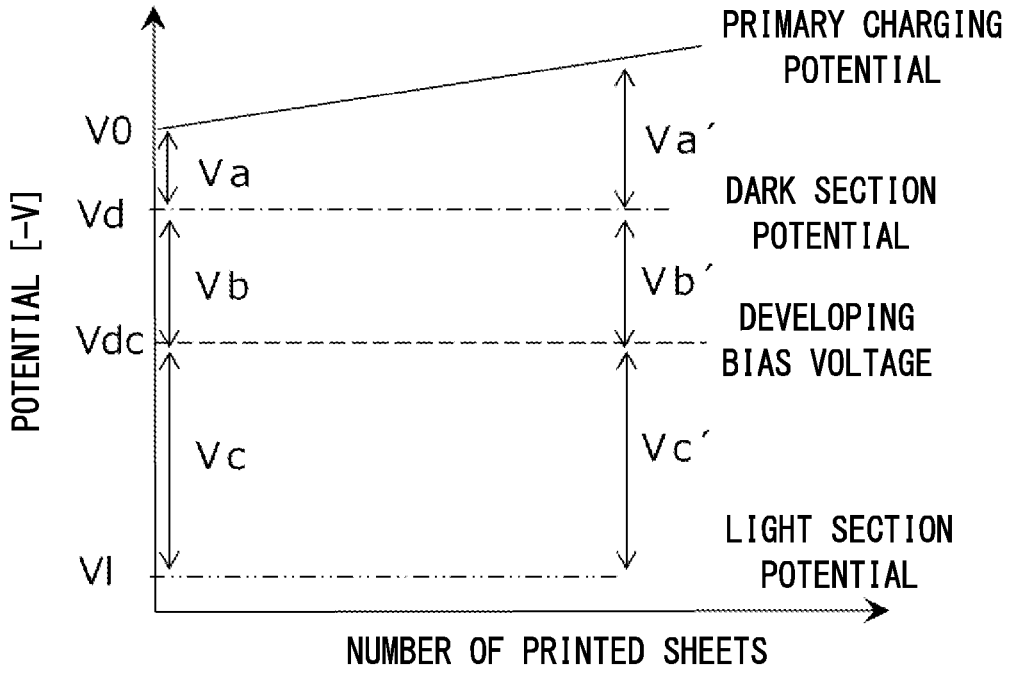

On the other hand, FIG. 6B is a graph schematically illustrating changes of the potentials Vd and Vl exhibited in a case where the laser exposure amounts E1 and E2 are changed based on the use information on the photosensitive drum (change in the film thickness of the photoconductive layer) with the charging voltage and the developing voltage fixed. In this case, when the photoconductive layer film thickness becomes 13 (μm) as in FIG. 5B, the laser exposure output values are set to E1=0.063 (μJ/cm$^2$) and E2=0.32 (μJ/cm$^2$), respectively. With this setting, in the same manner as when the film thickness of the photoconductive layer is 18 (μm), it is possible to obtain the desired dark section potential Vd=−440 (V) and the desired light section potential Vl=−150 (V). By thus controlling the laser exposure amounts E1 and E2 based on film thickness information on the photosensitive member, it is possible to maintain the stable dark section potential (Vd) and the stable light section potential (Vl) over the lifetime. However, in this case, the E-V curve changes along with the film thickness change of the photoconductive layer, and thereby a primary charging potential V0 rises, which forms a dark section contrast (Va') beyond necessity.

Figure 10A:
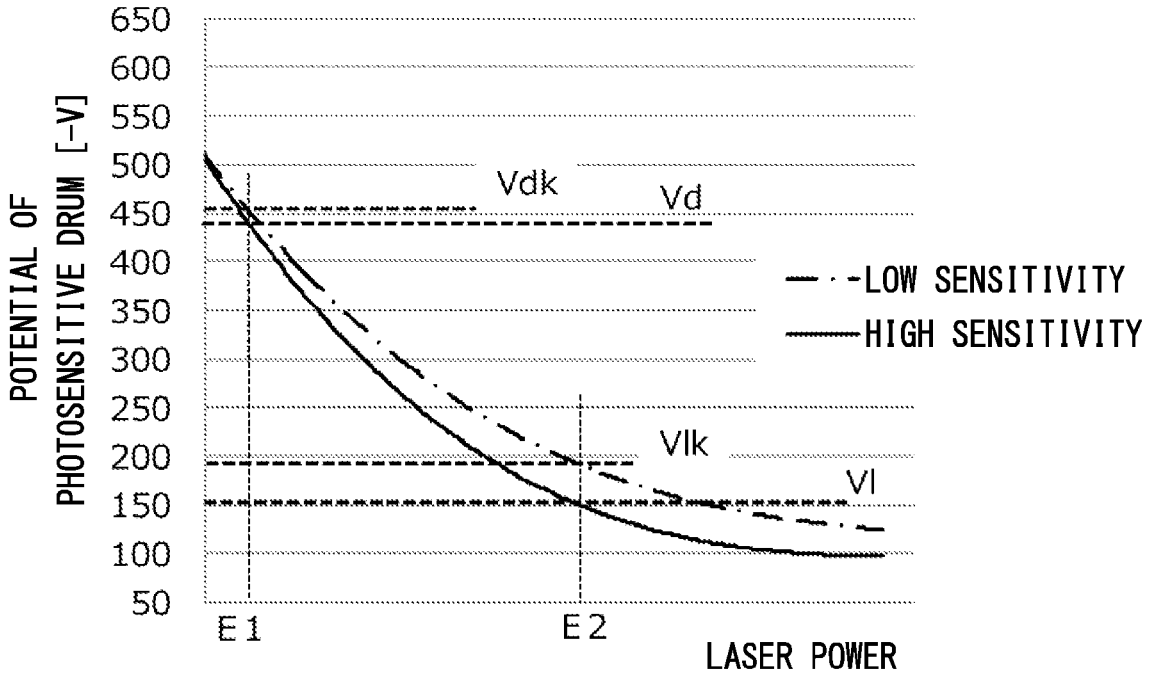
FIGS. 10A and 10B are graphs illustrating a relationship between a photoconductive layer sensitivity of the photosensitive drum and the E-V curve.

Further, factors which cause a change in the E-V curve of the photosensitive drum include variations of the sensitivity of the photoconductive layer. This is ascribable to manufacturing conditions, materials, and the like, indicating characteristics of the individual photosensitive drums. FIG. 10A illustrates E-V curves obtained when the photosensitive drums, which have a film thickness of 13 (μm) and differ in sensitivity, are charged to a predetermined primary charging potential. As illustrated in FIG. 10A, the sensitivity of the photoconductive layer affects the slope of the E-V curve. Also in this case, in a case where the laser exposure output values E1 and E2 are set by assuming that the photosensitive drum having a high sensitivity is used, the target dark section potential (Vd) and the target light section potential (Vl) cannot be obtained for the drum having a low sensitivity, and become Vdk and Vlk, respectively. Therefore, it is preferred that the laser exposure amounts E1 and E2 be adjusted based on photoconductive layer sensitivities.

At this time, degrees of influences exerted on the laser exposure amounts E1 and E2 by the photoconductive layer sensitivities are not necessarily the same. Pieces of information which are irrelevant to the film thickness but relate to a photosensitive characteristic of the photoconductive layer corresponding to the characteristics of materials and manufacture are stored in the memory 17 as pieces of information k1 and k2 relating to the photoconductive layer sensitivities at the time of manufacture. In other words, k1 and k2 represent the degree of influence of the photoconductive layer sensitivity exerted on the laser exposure amount E1 and the degree of influence of the photoconductive layer sensitivity exerted on the laser exposure amount E2, respectively.

(1-6) Description of Overall Schematic Structure and Configuration Relating to High Voltage Power Supply Circuit FIG. 4 is a wiring diagram illustrating how the charging bias power supply (charging power source) 602 and the developing bias power supply 601 are connected to the respective process cartridges according to the embodiment. As illustrated in FIG. 4, the charging bias power supply 602 is connected in common to the charging rollers 12Y to 12K of the process cartridges 10Y to 10K, respectively. In other words, the charging bias power supply 602 is configured to apply the same charging bias voltage to the charging rollers 12Y to 12K. In the same manner, the developing bias power supply 601 is connected in common to the developing rollers 13Y to 13K of the process cartridges 10Y to 10K, respectively. Also in this case, the developing bias power supply 601 is configured to apply the developing bias voltages having the same value to the developing rollers 13Y to 13K. In this manner, in the image forming apparatus 1 according to the embodiment, commonality can be achieved among the charging voltage and developing voltage power supplies to the process cartridges 10Y to 10K, which can downsize the apparatus and lower cost therefor.

Note that, in the embodiment, the charging bias power supply 602 is configured to output a variable DC voltage, while the developing bias power supply 601 is configured to output a DC voltage having a fixed value by using a Zener diode element. Further, it is possible to employ an image forming apparatus in which commonality is achieved among the DC bias voltages applied from a primary transfer bias power supply to respective primary transfer rollers.

(1-7) Description Relating to Charging Voltage Setting

The control portion 100 determines necessary dark section contrasts (Va) for the respective process cartridges 10Y to 10K from multiple color coverage rate information obtained by the image processing portion 103 serving as the image information obtaining unit and Table 1 obtained in advance. Specifically, for each of the process cartridges 10Y to 10K, the primary charging potential (V0) is determined so that the dark section contrast Va=60 (V) and the dark section potential Vd=−440 (V) can be ensured when the maximum value of the coverage rates for the multiple color section in the upstream stations is equal to or larger than 100%. Subsequently, the control portion 100 serving as a control unit and an obtaining unit according to the present invention reads a piece of information mi (μm) relating to the initial film thickness and a piece of information mj (μm) relating to an amount of a film thickness change from each of the memories 17Y to 17K of the process cartridges 10Y to 10K, respectively. Then, the film thickness (mi−mj) (μm) is calculated from those pieces of information. Subsequently, based on (Expression 1) described below, the control portion 100 calculates lower limit values (Vp−Y, Vp−M, Vp−C, and Vp−K) of the necessary charging voltages for the process cartridges 10Y to 10K, respectively. Finally, the control portion 100 determines the maximum value among the obtained lower limit values Vp−Y to Vp−K as a charging voltage (Vp) common to the respective process cartridges 10Y to 10K. That is, the charging voltage Vp that is not below any one of the lower limit values Vp−Y, Vp−M, Vp−C, and Vp−K may be selected. Here, an amount of the film thickness change mj (μm) is calculated from the number of printed sheets "t" (sheets), and is information written to the memory 17 as occasion arises along with an initial film thickness mi (μm).

$$Vp=\alpha\times(mi-mj)+V0-\beta \quad \text{(Expression 1)}$$

$$mj=\epsilon\times t \quad \text{(Expression 2)}$$

α, β, and ϵ: coefficients (1-8) Description Relating to Laser Power Control

Figure 7A:
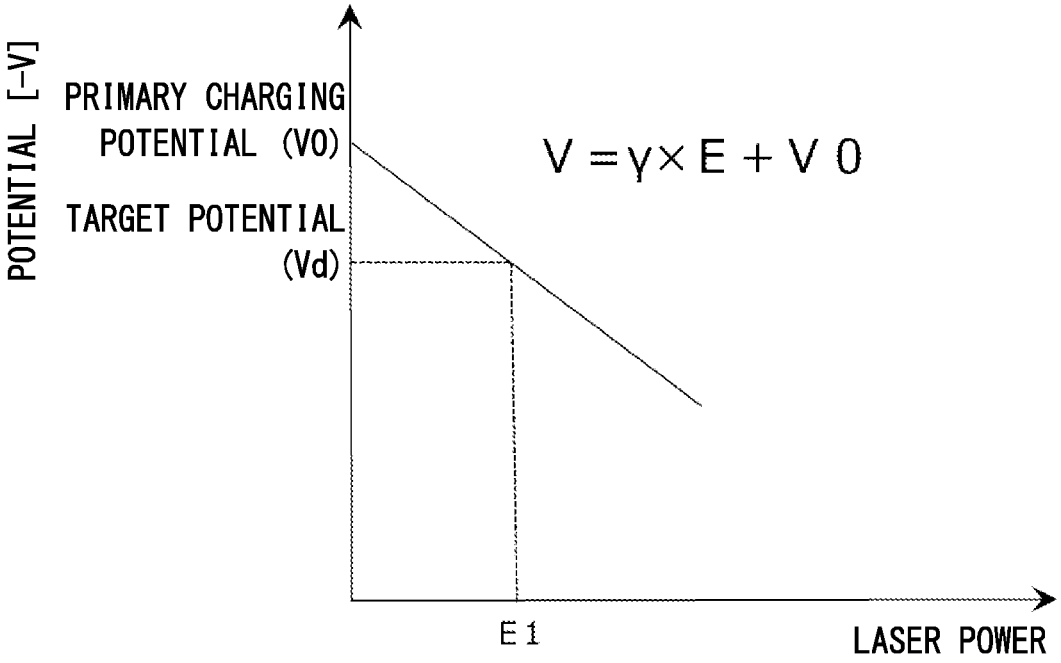
FIGS. 7A and 7B are graphs illustrating calculation methods for laser powers E1 and E2 according to the embodiment of the present invention.
Figure 7B:
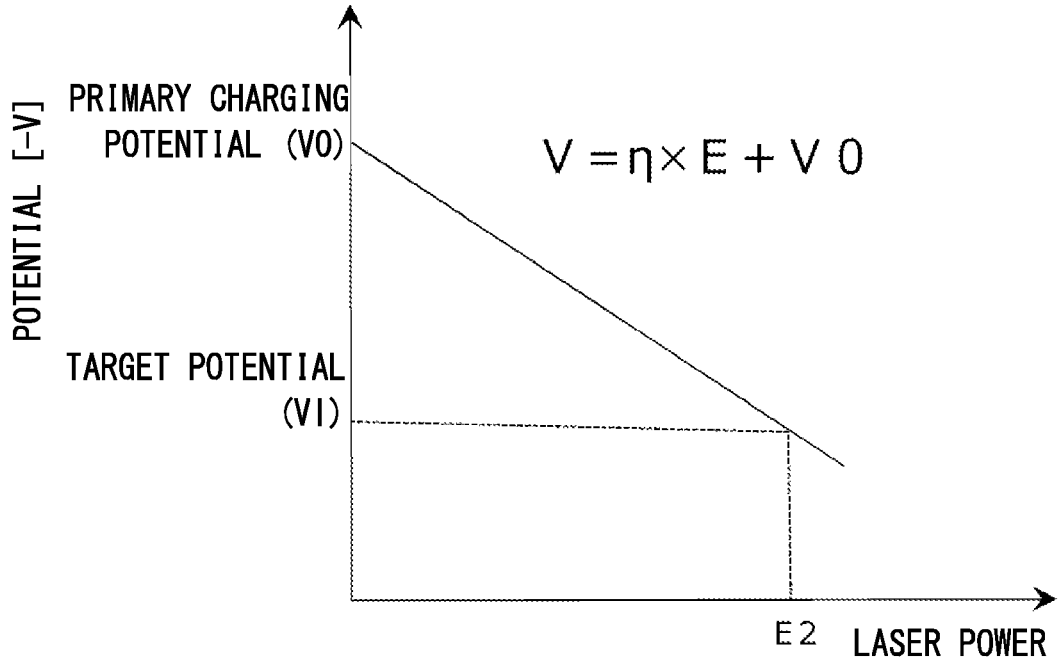

Next, with reference to FIG. 7A and FIG. 7B, a method of setting the laser powers having a non-image section exposure amount (E1) and an image section exposure amount (E2) according to the embodiment will be described below. FIG. 7A is a graph illustrating a calculation method for the laser power E1, and FIG. 7B is a graph illustrating a calculation method for the laser power E2. In the embodiment, the laser powers are controlled by precisely predicting the E-V curve from the film thickness at the time of manufacture (initial film thickness) of the photosensitive drum 11 and usage history information on the photosensitive drum 11, to thereby form the desired dark section potential (Vd) and the light section potential (Vl). Specifically, as illustrated in FIG. 7A and FIG. 7B, actual usage areas of the E-V curves of the photosensitive member are approximated by linear functions having different slopes. Then, the laser powers E1 and E2 necessary to obtain the target dark section potential Vd=−440 (V) and the target light section potential Vl=−150 (V), respectively, are calculated. The control portion 100 reads the piece of information mi (μm) relating to the initial film thickness, the piece of information mj (μm) relating to the amount of the film thickness change, and the pieces of information k1 and k2 relating to the photoconductive layer sensitivities from each of the memories 17Y to 17K of the process cartridges. Subsequently, based on the charging voltage (Vp) common to all the process cartridges determined by the above-mentioned method and (Expression 3) to (Expression 7) described below, the control portion 100 calculates the laser powers E1 and E2 for each of the process cartridges 10Y to 10K.

$$E1=k1\times(Vd+V0)/\gamma \quad \text{(Expression 3)}$$

$$E2=k2\times(Vl+V0)/\eta \quad \text{(Expression 4)}$$

$$V0=Vp-\alpha\times(mi-mj)+\beta \quad \text{(Expression 5)}$$

$$\gamma=\omega\times(mi-mj)+\tau \quad \text{(Expression 6)}$$

$$\eta=\mu\times\gamma \quad \text{(Expression 7)}$$

α, β, ω, τ, and μ: coefficients

Here, the initial film thickness mi (μm) and the pieces of information k1 and k2 relating to the photoconductive layer sensitivities are information written to the memory 17 at the time of manufacture. The laser powers E1 and E2 both increase proportionally to the change in the film thickness (mj), but as illustrated in FIG. 5A, increasing rates thereof (increasing rates of the laser power when mj=0) differ depending on the sensitivity characteristic of the photoconductive layer. Therefore, in the embodiment, the respective output values of E1 and E2 are calculated separately based on the film thickness of the photoconductive layer and the sensitivity characteristics (k1 and k2) of the photoconductive layers. Note that, (Expression 1) to (Expression 7), which are set as linear functions in the embodiment, are appropriately determined based on the characteristics of the photosensitive members and the image forming apparatus, and may be polynomial expressions or expressions formed of a plurality of curves. In the embodiment, the correlations are obtained by empirically obtaining the relationships among the film thicknesses, the charging voltages, and the primary charging potentials of the photosensitive drums in advance, and the mathematical expressions are not limited thereto. Further, with regard to the calculation of the amount of the film thickness change of the photoconductive layer, any one of or a combination of not only the number of printed sheets (the number of image formations) but also a charging bias application period, a rotation period of the photosensitive drum, and a total number of revolutions may be employed as an index indicating a frequency of use of the photosensitive drum. In addition, the coefficients α, β, ϵ, ω, τ, and μ are coefficients arbitrarily optimized based on the characteristics of the photosensitive member and the image forming apparatus. In a case where a sensor is provided to sense ambient conditions such as temperature and humidity under which the image forming apparatus is being used, further detailed control can be performed by being corrected correspondingly to the sensed ambient conditions. In the embodiment, the pieces of information of k1=1 and k2=1 relating to photosensitive member sensitivities and the coefficients of α=−10, β=360, ω=−80, τ=−700, μ=0.7, and $\epsilon=2.5\times10^{-3}$ are used.

(1-9) Flowchart Illustrating Photosensitive Member Surface Potential Control

Figure 1:
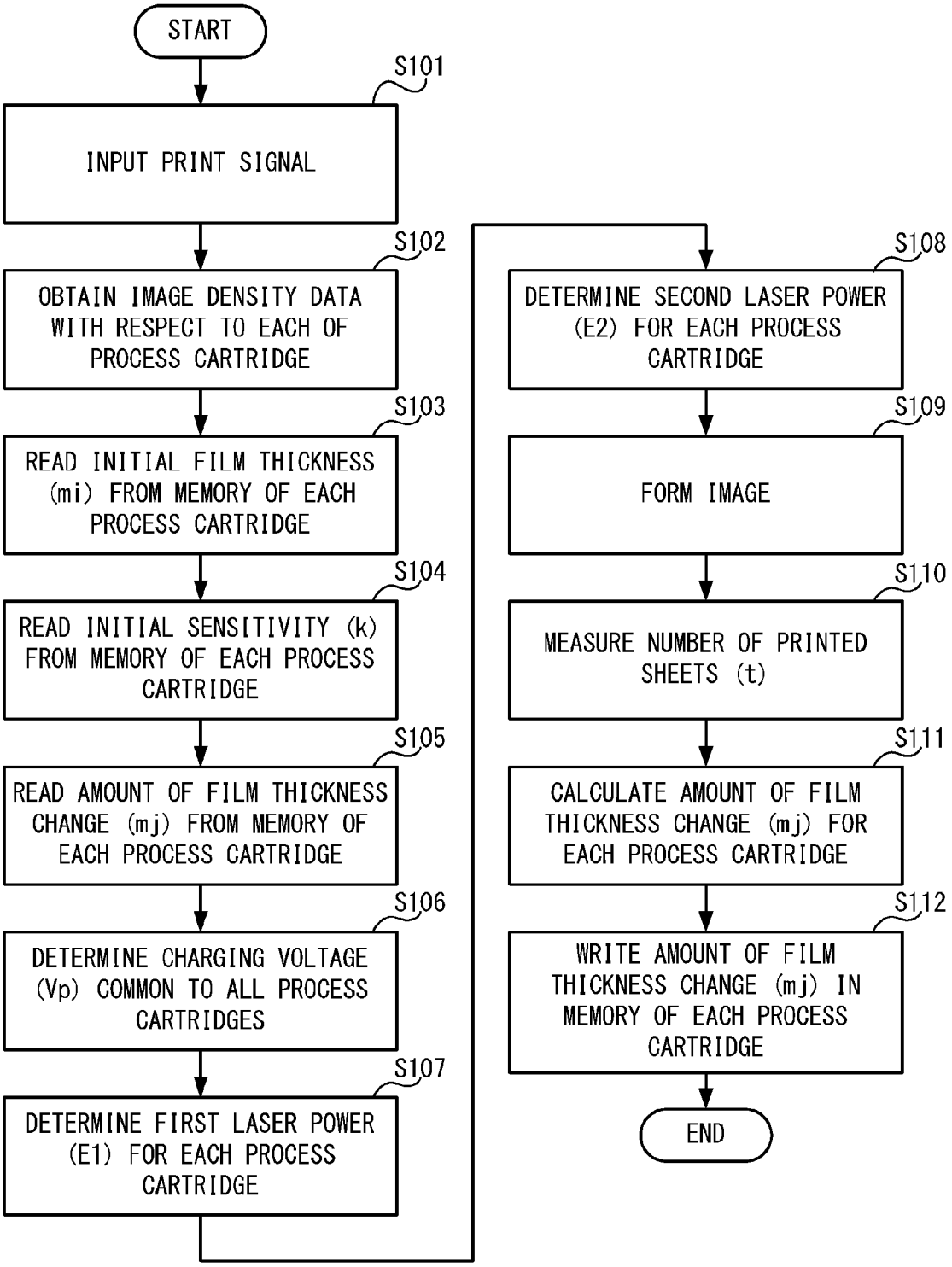
FIG. 1 is a flowchart illustrating control according to a first embodiment of the present invention.

Next, a laser power control method according to the embodiment will be described with reference to a flowchart illustrated in FIG. 1. When a print signal is input from the controller 200 (S101), the image processing portion 103 serving as the image information obtaining unit within the image forming apparatus 1 obtains the image density data on the respective colors (S102). Subsequently, the communication portion 101 within the image forming apparatus 1 communicates with the memories 17Y to 17K mounted to the respective process cartridges 10Y to 10K, respectively, to read various kinds of information stored in the respective memories (S103, S104, and S105). The information to be read includes the initial film thickness mi, the initial sensitivities (pieces of information relating to the photoconductive layer sensitivities) k1 and k2, and the amount of the film thickness change mj.

Subsequently, based on (Expression 1), the control portion 100 calculates the lower limit values (Vp−Y, Vp−M, Vp−C, and Vp−K) of the charging voltages for the respective process cartridges 10Y to 10K, respectively. Then, the control portion 100 determines the maximum value among the obtained lower limit values Vp−Y to Vp−K as the charging voltage (Vp) common to the respective process cartridges 10Y to 10K (S106). Subsequently, based on (Expression 3) to (Expression 7), the control portion 100 determines the first laser power E1 for each process cartridge (S107), and determines the second laser power E2 in the same manner (S108). The control portion 100 performs the image forming operation (S109), and measures the number of printed sheets "t" (S110). Then, the control portion 100 calculates the amount of the film thickness change mj from results of the measurement based on (Expression 2) (S111), and writes (overwrites) results of the calculation to the memory 17 of each process cartridge via the communication portion 101 (S112).

In other words, the gist of the laser power control method according to the embodiment is how to control the surface potential in an area corresponding to an area in which the toner images in the respective colors are superimposed on each other on the intermediate transfer belt 30 on the surface of the photosensitive drum 11. It is necessary to form a potential difference equal to or larger than a predetermined necessary magnitude between the surface potentials after the transfer voltage is applied in the previous image formation and before the charging voltage is applied in the subsequent image formation, and the surface potential formed by applying the charging voltage in the subsequent image formation. Such a charging potential is predicted for each photosensitive member based on the image density data. Then, a magnitude of the charging voltage applied to the charging roller 12 in order to form the predicted charging potential is predicted for each of the respective photosensitive drums 11 based on the photoconductive layer film thickness. The highest charging voltage among the predicted charging voltages is applied to each charging roller 12. The outputs of the first laser power E1 and the second laser power E2 for each of the photosensitive drums 11 are separately controlled based on a magnitude of the surface potential of the respective photosensitive drums 11 formed by the applied charging voltage. In the embodiment, as shown below in Table 2, respective prediction values described above are obtained by an experiment or the like in advance and provided in the form of table.

TABLE 2

| | Yellow (Y) | Magenta (M) | Cyan (C) | Black (K) |
|---|---|---|---|---|
| (a) | | | | |
| Image A | | | | |
| Necessary Va (V) | 0 | 0 | 60 | 60 |
| Vp (V) | −980 | −950 | −990 | −960 |
| V0 (V) | −450 | −480 | −500 | −530 |
| E1 (μJ/cm$^2$) | 0.004 | 0.021 | 0.034 | 0.06 |
| E2 (μJ/cm$^2$) | 0.20 | 0.248 | 0.287 | 0.362 |

TABLE 2-continued

| | Yellow (Y) | Magenta (M) | Cyan (C) | Black (K) |
|---|---|---|---|---|
| (b) | | | | |
| Image B | | | | |
| Necessary Va (V) | 0 | 0 | 0 | 0 |
| Vp (V) | −980 | −950 | −930 | −900 |
| V0 (V) | −440 | −470 | −490 | −520 |
| E1 (μJ/cm$^2$) | 0.0 | 0.016 | 0.029 | 0.053 |
| E2 (μJ/cm$^2$) | 0.194 | 0.240 | 0.279 | 0.352 |

As an example of performing the above-mentioned control, the respective process cartridges in which the photosensitive member film thicknesses are yellow (Y): 18 (μm), magenta (M): 15 (μm), cyan (C): 13 (μm), and black (K): 10 (μm) are used. Then, an image A including a red color having a coverage rate of 200% and an image B including a blue color having a coverage rate of 80% are printed in the respective process cartridges. In this case, as shown in part (a) of Table 2, in the case of the image A, from the viewpoint of controlling the multiple color transfer ghost, necessary primary charging potentials (V0) with respect to the respective process cartridges become Y: −440 (V), M: −440 (V), C: −500 (V), and K: −500 (V). That is, from each of the photosensitive member film thicknesses, in order to appropriately charge the photosensitive drum 11, the lowest necessary values of the charging voltages (Vp) become, as shown in part (a) of Table 2, Y: −980 (V), M: −950 (V), C: −990 (V), and K: −960 (V). In order to avoid becoming below any one of those Vp−Y=−980 (V), Vp−M=−950 (V), Vp−C=−990 (V), and Vp−K=−960 (V), the common charging voltage (Vp) is determined to be −990 (V) being the maximum value among those. As a result, the photosensitive drums of the respective process cartridges charged with the charging voltage (Vp) of −990 (V) have the primary charging potentials (V0) shown in Table 2. In other words, the potentials of the drums for the respective colors become Y: −450 (V), M: −480 (V), C: −500 (V), and K: −530 (V), being the potentials above the necessary primary charging potentials. Further, in order to form a dark section potential Vd=−440 (V) necessary for forming an image, necessary background area exposure amounts (E1) become Y: 0.004 (μJ/cm$^2$), M: 0.021 (μJ/cm$^2$), C: 0.034 (μJ/cm$^2$), and K: 0.06 (μJ/cm$^2$). Further, in order to form a light section potential Vl=−150V necessary for forming an image, necessary background area exposure amounts (E2) become Y: 0.20 (μJ/cm$^2$), M: 0.248 (μJ/cm$^2$), C: 0.287 (μJ/cm$^2$), and K: 0.362 (μJ/cm$^2$). Note that, in the embodiment, the values of V0 and Vp are negative. In the description, the lower limit value and the maximum value of the potential mean values whose absolute values have a lower limit magnitude and a maximum magnitude.

On the other hand, in the case of the image B, the multiple color section has the coverage rate 90% at the maximum, and hence there is no fear that the multiple color transfer ghost may occur. Therefore, as shown in part (b) of Table 2(a), necessary primary charging potentials (V0) with respect to the photosensitive drums 11 of the respective process cartridges become −440 (V) for all the colors. That is, from each of the photosensitive member film thicknesses, the lowest necessary values of the charging voltages (Vp), become Y: −980 (V), M: −950 (V), C: −930 (V), and K: −900 (V), and the −980 (V) being the maximum value among those is determined as the common charging voltage (Vp). As a result, the primary charging potentials (V0) of the photosensitive drums 11 for the respective colors are, as shown in part (b) of Table 2, Y: −440 (V), M: −470 (V), C: −490 (V), and K: −520 (V). Further, in order to form a dark section potential Vd=−440 (V) necessary for forming an image, necessary background area exposure amounts (E1) become Y: 0.0 (μJ/cm$^2$), M: 0.016 (μJ/cm$^2$), C: 0.029 (μJ/cm$^2$), and K: 0.053 (μJ/cm$^2$). Further, in order to form a light section potential Vl=−150V necessary for forming an image, necessary background area exposure amounts (E2) become Y: 0.194 (μJ/cm$^2$), M: 0.240 (μJ/cm$^2$), C: 0.279 (μJ/cm$^2$), and K: 0.352 (μJ/cm$^2$).

As described above, it is understood that the exposure amount for the photosensitive drum can be minimized in the case where the multiple color coverage rate is low. Note that, the ghost image occurs neither in the image A nor in the image B. This is because the lower limit values Vp−M, Vp−C, and Vp−K of the charging potentials corresponding to magenta (M), cyan (C), and black (K) change depending on the density of the developer image formed on the photosensitive drum located in the upstream of the photosensitive drum corresponding to the own color. With this configuration, it is possible to set Vp having such a magnitude as to prevent the occurrence of a multiple color transfer ghost image.

For example, the value of Vp−C corresponding to the photosensitive drum for cyan is determined based on the image densities of the developer image in yellow and the developer image in magenta that are transferred onto the intermediate transfer belt 30 earlier than the developer image in cyan. The surface potential of the photosensitive drum 11 for cyan tends to be non-uniform during the image formation more often in a case where the integrated value of the image densities for yellow and magenta is large (case of forming the image A) than in a case where the integrated value of the image densities is small (case of forming the image B). That is, in the case of forming the image A, when the photosensitive drum 11 for cyan is brought into contact with the toner images in yellow and magenta that have been formed on the intermediate transfer belt 30, the surface potential of the photosensitive drum greatly changes between an area brought into contact with the toner images and an area that is not brought into contact therewith. If the image formation is continued as it is, the influence of the images in yellow and magenta may be exerted on the surface potential of the photosensitive drum 11 for cyan in the second rotation and the subsequent rotations of the photosensitive drum 11.

However, in the embodiment, Vp−C is set larger in the case of the image A than in the case of the image B. Therefore, as shown in Table 2, −990 V is selected as a charging potential Vp used when the image A is formed, and has a larger absolute value (magnitude) than −980 V being Vp used when the image B is formed. Accordingly, even when the surface potential of the photosensitive drum 11 for cyan becomes non-uniform in the part brought into contact with the intermediate transfer belt 30 during the formation of the image A, the uniformity of the potential of the photosensitive drum 11 is easily restored by the charging. That is, the surface potential of the photosensitive drum 11 remains stable while the image A is being formed. The influence of the images formed in magenta and yellow is prevented from being exerted in the toner image formed in cyan.

Note that, Vp−M corresponding to the photosensitive drum 11 for magenta is determined based on the image density of the developer image in yellow that is transferred onto the intermediate transfer belt 30 earlier than the developer image in magenta. Further, Vp−K corresponding to the photosensitive drum 11 for black is determined based on the integrated value obtained by integrating all the image densities of the developer images in yellow (Y), magenta (M), and cyan (C) which are transferred onto the intermediate transfer belt 30 earlier than the developer image in black (K). Accordingly, it is possible to stabilize even the surface potentials of the photosensitive drums 11 for magenta and black in the same manner as that of the photosensitive drum 11 for cyan. The influence (ghost image) of the image formed on the photosensitive drum 11 on the upstream side can be prevented from being exerted (from occurring) in the image formed on the photosensitive drum 11 on the downstream side.

Note that, the laser power according to the embodiment is defined as the exposure amount received by the surface of the photosensitive member rotationally driven at a surface speed of 120 (mm/sec), and it is assumed that the control portion 100 controls laser output values in order to obtain the respective exposure amounts. Further, in the embodiment, the dark section contrast is changed stepwise based on Table 1 obtained in advance, but further detailed control can also be performed by using a function to define the relationship between the multiple color coverage rate and the dark section contrast.

As described above, in the embodiment, the maximum value of the multiple color coverage rate is sensed to control the charging voltage and the exposure amount. Therefore, the desired non-image section potential (Vd) and the desired image section potential (Vl) can be formed with the minimum exposure amount without causing the multiple color transfer ghost image. Further, the number of power supplies can be minimized by using each of the power supplies for the charging voltage and the developing voltage in common, which can downsize the apparatus and lower the cost therefor.

Second Embodiment

An image forming apparatus, a photosensitive drum, latent image setting, a high voltage power supply circuit according to a second embodiment of the present invention are the same as those according to the first embodiment. In the embodiment, the laser powers E1 and E2 are controlled by further improving precision of the prediction of the E-V curve in consideration of an exposure history (exposed amount) of the photosensitive drum.

(2-1) Description Relating to E-V Characteristic of Photosensitive Member

Figure 10B:
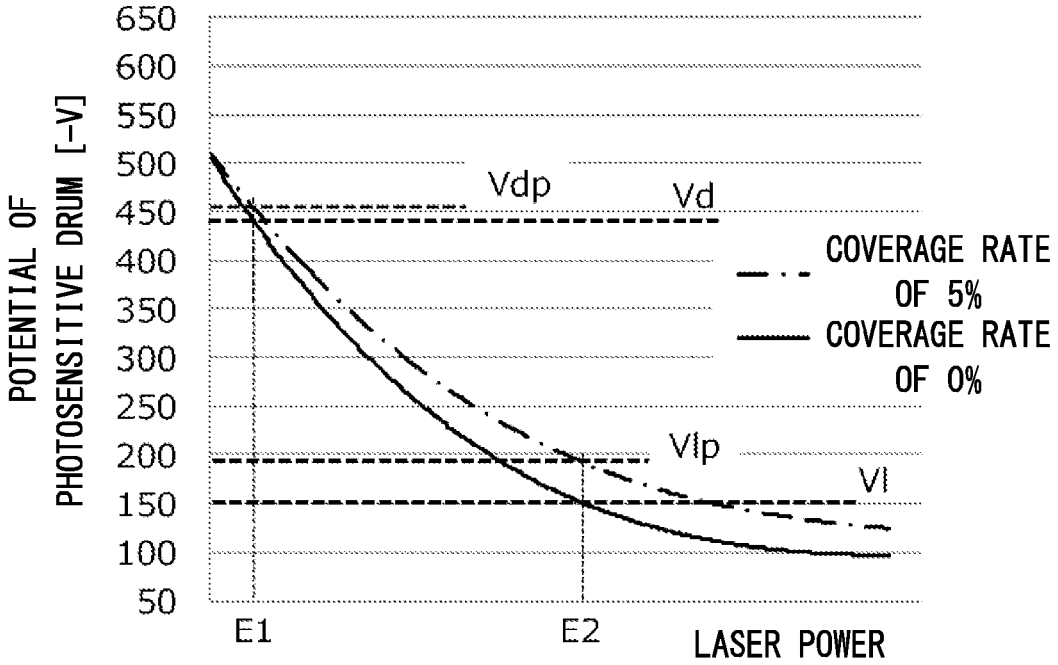

As the factor which causes a change in the potential along with the use of the photosensitive drum, a change (reduction) in the sensitivity due to laser exposure occurs in addition to the change of the photoconductive layer film thickness. The change in the sensitivity slightly occurs over the use of the photosensitive member even in the case where the non-image section exposure amount is controlled to be suppressed to a minimum as in the embodiment. This is because the non-image section exposure (E1) and image section exposure (E2) are repeated to cause the cumulate residual charges within the photoconductive layer. Therefore, the degree of the change in the sensitivity differs depending on a laser exposure area, in other words, the number of pieces of image data, in addition to the number of image formations, and a residual charge amount increases as cumulative exposure energy increases. As an example, FIG. 10B illustrates the E-V curve of the photosensitive drum having a film thickness of 13 (μm) after printing of 20,000 (sheets) has been performed with a coverage rate of 0% and a coverage rate of 5%. It is understood that the E-V curve changes depending on a history of print image data (so-called exposed history). In a case where the laser exposure output values E1 and E2 are set by assuming the photosensitive drum which does not have the exposure history, the dark section potential (Vd) and the light section potential (Vl) cannot achieve the targets values for the drum having the exposure history, and become Vdp and Vlp, respectively. Therefore, in the embodiment, the exposure history (exposed amount) of the photosensitive drum is detected, and when the exposure history is large, the correction is performed so as to increase the laser powers E1 and E2, to thereby precisely form the dark section potential (Vd) and the light section potential (Vl). The E-V curve of the photosensitive drum according to the embodiment changes depending on the exposure history as illustrated in FIG. 10B, and hence it is preferred that a correction factor for the laser power E2 be set larger than a correction factor for the laser power E1.

(2-2) Description Relating to Photosensitive Member Surface Potential Control According to the Embodiment In the embodiment, the exposure history (ρ) of the photosensitive member of each of the process cartridges is detected. Specifically, the control portion 100 measures the number of pixels from the print image data, and calculate an integrated pixel value (P), to thereby obtain the exposure history caused by the image section exposure amount (E2). On the other hand, the number of image formations (the number of printed sheets) can be used as the exposure history caused by the non-image section exposure amount (E1). For example, in a case where printing of 1,000 (sheets) is performed with the coverage rate of 5%, an integrated pixel value P is measured as 5,000, and the exposure history (ρ) is calculated as $5.8\times10^{-3}$ based on (Expression 10) described below. The exposure history (ρ) is information written to the memory 17 as occasion arises each time the printing is performed.

In the same manner as the method described in the first embodiment, the control portion 100 sets the dark section contrast (Va) based on the multiple color coverage rate, and uses (Expression 1) to determine the common charging voltage (Vp).

Subsequently, the control portion 100 reads the piece of information mi (μm) relating to the initial film thickness, the piece of information mj (μm) relating to the amount of the film thickness change, the pieces of information k1 and k2 relating to the photoconductive layer sensitivities, and the exposure history (ρ) from each of the memories 17Y to 17K. The obtained pieces of information and (Expression 5) to (Expression 10) are used to calculate the laser powers E1 and E2 (μJ/cm$^2$) necessary for obtaining the dark section potential Vd=−440 (V) and the light section potential Vl=−150 (V), respectively.

$$E1=(1+\rho)\times k1\times(Vd-V0)/\gamma \quad \text{(Expression 8)}$$

$$E2=(1+\gamma\times\rho)\times k2\times(Vl-V0)/\eta \quad \text{(Expression 9)}$$

$$\rho=\zeta\times P+\delta\times t \quad \text{(Expression 10)}$$

δ, γ, and ζ: coefficients

In the embodiment, the coefficients of $\gamma=1.1$, $\delta=1.8\times10^{-6}$, and $\zeta=8\times10^{-7}$ are used. Further, in the same manner as in the first embodiment, the pieces of information of k1=1 and k2=1 relating to photosensitive member sensitivities, and the coefficients of $\alpha=-10$, $\beta=360$, $\omega=-80$, $\tau=-700$, $\mu=0.7$, and $\epsilon=2.5\times10^{-3}$ are used. Note that, the respective mathematical expressions and the respective coefficients are appropriately determined based on the characteristics of the photosensitive members and the image forming apparatus, and the present invention is not limited thereto.

(2-3) Flowchart Illustrating Photosensitive Member Surface Potential Control

Figure 9:
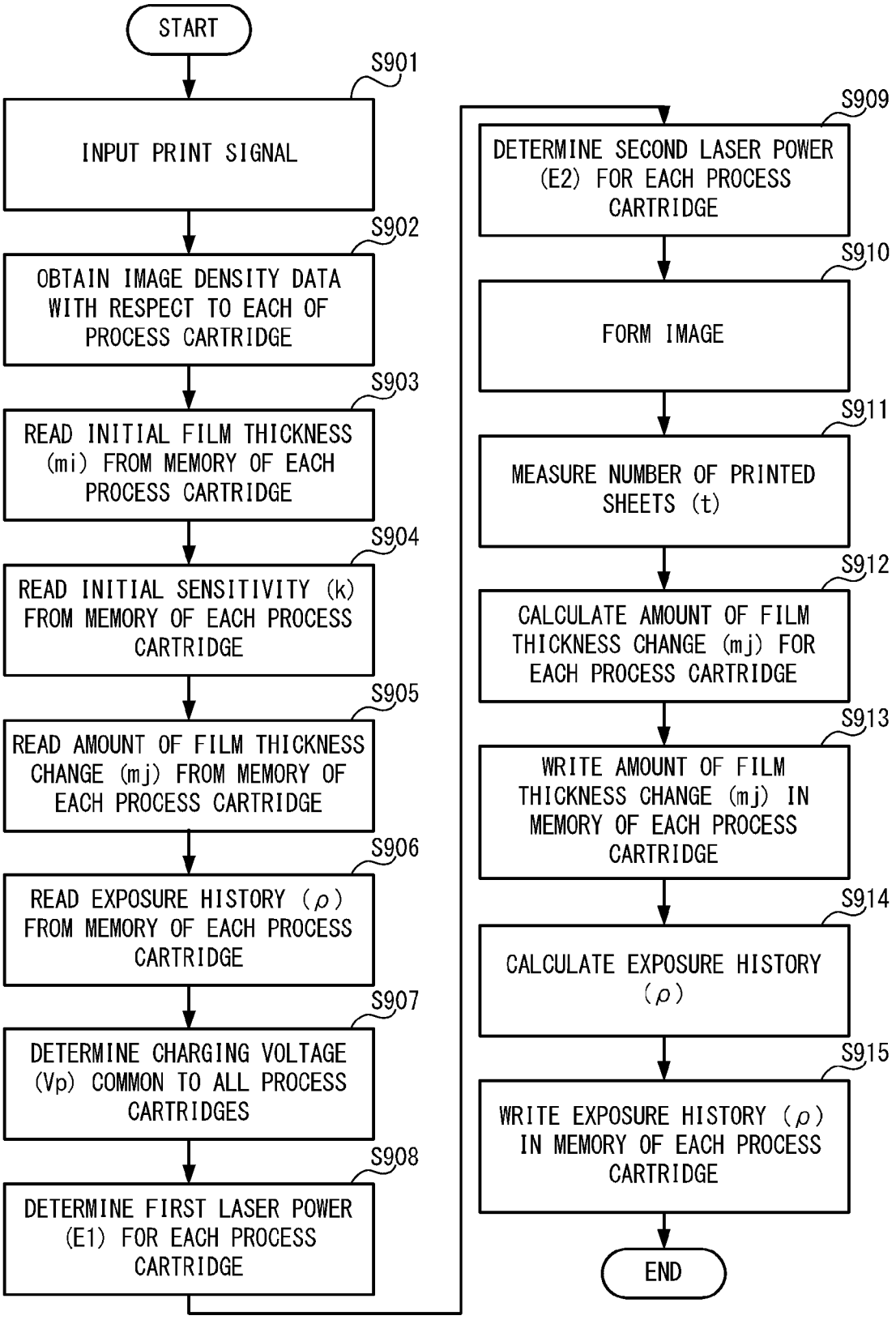
FIG. 9 is a flowchart illustrating control according to a second embodiment of the present invention.

With reference to a flowchart illustrated in FIG. 9, a laser power control method according to the embodiment will be described. When the print signal is input from the controller 200 (S901), the image processing portion 103 serving as the image information obtaining unit within the image forming apparatus 1 obtains the image density data on the respective colors (S902). Subsequently, the communication portion 101 in the image forming apparatus 1 communicates with the memories 17Y to 17K mounted to the respective process cartridges 10Y to 10K to read various kinds of information stored in the respective memories (S903, S904, S905, and S906). The information to be read includes the initial film thickness mi, the initial sensitivities (pieces of information relating to the photoconductive layer sensitivities) k1 and k2, the amount of the film thickness change mj, and the exposure history (ρ)

Subsequently, based on (Expression 1), the control portion 100 calculates the lower limit values (Vp−Y, Vp−M, Vp−C, and Vp−K) of the charging voltages for the respective process cartridges 10Y to 10K, respectively. Then, the control portion 100 determines the maximum value among the obtained lower limit values Vp−Y to Vp−K as the charging voltage (Vp) common to the respective process cartridges 10Y to 10K (S907). Subsequently, based on (Expression 5) to (Expression 10), the control portion 100 determines the first laser power E1 for each process cartridge (S908), and determines the second laser power E2 in the same manner (S909). The control portion 100 performs the image forming operation (S910), and measures the number of printed sheets (t) (S911). Then, the control portion 100 calculates the amount of the film thickness change mj from the results of the measurement based on (Expression 2) (S912), and writes (overwrites) the results of the calculation to the memory 17 of each process cartridge via the communication portion 101 (S913). Subsequently, the control portion 100 calculates the exposure history (ρ) from the integrated pixel value (P) measured along with the number of printed sheets (t) based on (Expression 10) (S914). Then, the control portion 100 writes (overwrites) the results of the calculation to the memory 17 of each process cartridge via the communication portion 101 (S915).

As an example of performing the above-mentioned control, in the cyan 10C station, the photosensitive drum having an initial film thickness of 18 (μm) is used to print the image having the coverage rate of 5% on 20,000 (sheets), and then an image C including the red color having a coverage rate of 200% is printed. At this time, it is assumed that the cyan 10C station has the largest photosensitive member film thickness. When the image C is printed, the control portion 100 sets the charging voltage Vp=−990 (V) as the charging voltage for the photosensitive drum of the cyan 10C station which has changed to have the film thickness of 13 (μm) so as to obtain the dark section contrast Va=60 (V) and the primary charging potential V0=−500 (V). Subsequently, by setting the respective laser output values to E1=0.0384 (μJ/cm$^2$) and E2=0.324 (μJ/cm$^2$), it is possible to obtain the dark section potential Vd=−450 (V) and the light section potential Vl=−150 (V).

Note that, the present invention can also be applied to a case where the laser powers E1 and E2 according to the present invention are two levels of exposure amounts formed by changing a light emission period based on a pulse width modulation. In addition, the light source is not limited to a laser diode, and the present invention can also be applied to a case of using an LED or the like. Further, in the embodiment, the results of calculating the exposure history (ρ) are stored in the memory 17 of each process cartridge, but another method may be used. For example, the present invention can be applied to a method in which the integrated pixel value (P) and the number of printed sheets (t) are stored in the memory 17 and the control portion 100 calculates the exposure history (ρ) as occasion arises.

Further, in the embodiments, the descriptions have been made by employing a DC charging system in which the bias applied to the charging unit is a DC voltage. This is because the image failure due to the non-uniform charging is more likely to occur in the DC charging system. However, the present invention is not limited to DC charging. For example, even in a case of a so-called AC charging system in which the charging is performed by superimposing an AC voltage on the DC voltage, the present invention can be applied to any image forming apparatus that forms the potential by exposing the non-image section and the image section.

CONCLUSION

In the above-mentioned first embodiment and second embodiment, the control portion 100 is configured to control the charging potential Vp and the laser powers E1 and E2 in the subsequent image formation based on the image density of the image (developer image) formed in the previous image formation. It is possible to maintain the magnitude of the charging voltage Vp and the magnitudes of the laser powers E1 and E2 to a minimum and suppress wear of the photosensitive drum. In this case, the control portion 100 sets Vp−Y, Vp−M, Vp−C, and Vp−K as the lower limit values of the charging voltage necessary for the photosensitive drums 11 for the respective colors, and sets the charging voltage Vp to be applied in actuality so as to become below none of those lower limit values. Based on the image density of the developer image transferred onto the intermediate transfer belt 30 earlier, the control portion 100 sets the lower limit value of the charging voltage for the photosensitive drum 11 on which the developer image to be transferred onto the intermediate transfer belt 30 thereafter is formed. For example, the lower limit value Vp−C set for the photosensitive drum 11 for cyan (C) is determined based on the image densities of the developer images in yellow (Y) and magenta (M). Accordingly, even when the charging bias power supply 602 applies the charging voltage to the respective charging rollers in common, it is possible to set the charging potential Vp which is sufficient to uniformly charge the respective photosensitive drums 11, which can suppress the occurrence of the multiple color transfer ghost.

To summarize the above description, the image forming apparatus according to the above-mentioned first embodiment and second embodiment can form a stable surface potential of the photosensitive member by preventing the occurrence of a transfer memory image while suppressing the reduction in the sensitivity of the photosensitive member, and is superior in space savings and cost reduction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-259735, filed Nov. 28, 2012, which is hereby incorporated by reference in its entirety.

What is claimed is:

1. An image forming apparatus configured to form an image on a recording medium, the image forming apparatus comprising:

a plurality of photosensitive members;

a plurality of charging devices to which a common charging power source applies a charging voltage to charge the plurality of photosensitive members;

an exposure device configured to expose surfaces of the plurality of photosensitive members, which have been charged by the plurality of charging devices, with a first laser power to form a non-image section potential, and expose the surfaces with a second laser power to form an image section potential;

a plurality of developing devices configured to make developers adhere to areas in which the image section potential is formed to form developer images on the plurality of photosensitive members;

a transfer device to which a transfer voltage is applied to transfer the developer images formed on the plurality of photosensitive members onto a transfer medium so as to sequentially superimpose the developer images on top of each other; and a control portion configured to control a magnitude of the charging voltage applied from the common charging power source and an output of a laser power from the exposure device, wherein the control portion is configured to set a lower limit value of the charging voltage for each of the plurality of photosensitive members, apply the charging voltage having a magnitude not less than any lower limit value from the common charging power source to the plurality of charging devices, and control the output of the laser power for each of the plurality of photosensitive members individually, and wherein the lower limit value for each of a second and subsequent photosensitive members in order of transferring the developer images from the plurality of photosensitive members onto the transfer medium is set based on a density of a developer image formed by a photosensitive member located before a corresponding one of the second and subsequent photosensitive members.

2. An image forming apparatus according to claim 1, wherein the lower limit value for each of the second and subsequent photosensitive members is set based on densities of developer images formed by all photosensitive members located before the corresponding one of the second and subsequent photosensitive members.

3. An image forming apparatus according to claim 2, wherein the lower limit value for each of the second and subsequent photosensitive members is set to be larger as an integrated value of the densities of the developer images formed by all the photosensitive members located before the corresponding one of the second and subsequent photosensitive members becomes larger.

4. An image forming apparatus according to claim 1, further comprising an obtaining unit configured to obtain a film thickness of a photoconductive layer of each of the plurality of photosensitive members, wherein the control portion is configured to set the lower limit value for each of the plurality of photosensitive members based on the film thickness of the photoconductive layer thereof.

5. An image forming apparatus according to claim 1, further comprising an obtaining unit configured to obtain a film thickness of a photoconductive layer of each of the plurality of photosensitive members, wherein the control portion is configured to set the output of the laser power for exposing each of the plurality of photosensitive members based on the film thickness of the photoconductive layer thereof.

6. An image forming apparatus according to claim 4, wherein the obtaining unit is configured to calculate the film thickness of each of the photoconductive layers based on an initial film thickness of the photoconductive layer and an amount of a film thickness change calculated based on a frequency of use of a corresponding one of the plurality of photosensitive members.

7. An image forming apparatus according to claim 6, wherein the frequency of use of the corresponding one of the plurality of photosensitive members is calculated based on at least one of a number of image formations, a total number of revolutions of the corresponding one of the plurality of photosensitive members, or a period for applying the charging voltage to a corresponding one of the plurality of charging devices.

8. An image forming apparatus according to claim 1, wherein the control portion controls the output of the laser power for exposing each of the plurality of photosensitive members based on an exposed amount of a corresponding one of the plurality of photosensitive members.

9. An image forming apparatus according to claim 8, wherein the exposed amount is calculated based on at least one of a number of pixels of the image to be formed or a number of image formations.

10. An image forming apparatus according to claim 1, further comprising a plurality of cleaning devices configured to clean the plurality of photosensitive members, wherein each of the plurality of photosensitive members is formed as a process cartridge integrally with at least one of a corresponding one of the plurality of charging devices, a corresponding one of the plurality of developing devices, or a corresponding one of the plurality of cleaning devices, the process cartridge being detachably attachable to a main body of the image forming apparatus.

11. An image forming apparatus according to claim 10, further comprising a plurality of storage units configured to store information relating to the plurality of photosensitive members, the information comprising at least an initial film thickness, a sensitivity characteristic, a frequency of use, and an exposed history of a photoconductive layer of each of the plurality of photosensitive members, wherein each of the plurality of storage units is formed integrally with a corresponding one of the plurality of process cartridges.

12. An image forming apparatus according to claim 1, wherein the control portion is configured to set a largest lower limit value among lower limit values set with respect to each of the plurality of photosensitive members as the magnitude of the charging voltage applied from the charging power source to the plurality of charging devices.

13. An image forming apparatus according to claim 1, wherein a common developing power source applies a developing voltage to the plurality of the developing devices.

* * * * *